US011578626B2

(12) United States Patent
Sturgin et al.

(10) Patent No.: US 11,578,626 B2
(45) Date of Patent: Feb. 14, 2023

(54) PHASING MECHANISM WITH ROLLER RAMPS

(71) Applicant: Schaeffler Technologies AG & Co. KG, Herzogenaurach (DE)

(72) Inventors: Todd Sturgin, Wooster, OH (US); Jeffrey Hemphill, Copley, OH (US); Chris Luipold, Wadsworth, OH (US); Joshua Hixenbaugh, Wooster, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 7 days.

(21) Appl. No.: 17/348,220

(22) Filed: Jun. 15, 2021

(65) Prior Publication Data

US 2021/0396161 A1 Dec. 23, 2021

Related U.S. Application Data

(60) Provisional application No. 63/040,575, filed on Jun. 18, 2020.

(51) Int. Cl.
*F01L 1/344* (2006.01)

(52) U.S. Cl.
CPC ... *F01L 1/3442* (2013.01); *F01L 2001/34426* (2013.01); *F01L 2001/34453* (2013.01); *F01L 2001/34479* (2013.01)

(58) Field of Classification Search
CPC ..... F01L 1/344; F01L 1/3442; F01L 2001/34426; F01L 2001/3443; F01L 2001/34433; F01L 2001/34453; F01L 2001/34479; F01L 2001/34483; F01L 2305/02
See application file for complete search history.

(56) References Cited

U.S. PATENT DOCUMENTS

| | | | | |
|---|---|---|---|---|
| 2,037,051 | A | 4/1936 | Smiley | |
| 2,057,354 | A | 10/1936 | Withers et al. | |
| 6,213,071 | B1 * | 4/2001 | Lancefield | F01L 1/34406 123/90.31 |

(Continued)

FOREIGN PATENT DOCUMENTS

| | | |
|---|---|---|
| GB | 16063 | 9/1901 |
| GB | 132699 | 9/1919 |
| GB | 288962 | 6/1928 |

OTHER PUBLICATIONS

Author: Hrusch et al., Cranktrain Phase Adjuster for Variable Compression Ratio Source: U.S. Appl. No. 17/324,922, filed May 19, 2021 Country: United States.

(Continued)

*Primary Examiner* — Loren C Edwards

(57) ABSTRACT

A phasing mechanism for an internal combustion is provided. The phasing mechanism includes a stator, a rotor configured to rotate relative to the stator, a first plurality of rolling elements configured to engage and move the rotor in a first rotational direction, a second plurality of rolling elements configured to engage and move the rotor in a second rotational direction, and a piston configured to be hydraulically actuated in: i) a first axial direction to move the rotor in the first rotational direction, and ii) a second axial direction to move the rotor in the second rotational direction.

20 Claims, 15 Drawing Sheets

(56) References Cited

U.S. PATENT DOCUMENTS

| | | | | |
|---|---|---|---|---|
| 10,072,537 | B2 | 9/2018 | Schmitt et al. | |
| 2003/0029399 | A1 | 2/2003 | Yamamuro et al. | |
| 2008/0163836 | A1 | 7/2008 | Taye et al. | |
| 2019/0234250 | A1* | 8/2019 | Schmitt | F01L 1/047 |

OTHER PUBLICATIONS

Author: Hrusch et al., Cranktrain Phase Adjuster for Variable Compression Ratio Source: U.S. Appl. No. 63/027,977, filed May 21, 2020, Country: United States.

* cited by examiner

PHASING MECHANISM WITH ROLLER RAMPS

CROSS-REFERENCE TO RELATED APPLICATIONS

This application claims the benefit under 35 U.S.C. § 119(e) of U.S. Provisional Application No. 63/040,575 filed on Jun. 18, 2020, which application is incorporated herein by reference.

TECHNICAL FIELD

This disclosure is generally related to a phasing mechanism for an internal combustion (IC) engine.

BACKGROUND

Phasing mechanisms or phase adjusters can be utilized within IC engines to vary a phase relationship of one rotational element relative to another. One example of a phasing mechanism varies a rotational position of a camshaft relative to a crankshaft to vary a valve timing within a four-stroke engine cycle to optimize the performance and emissions of the IC engine. Another example of a phasing mechanism varies a rotational position of a first shaft relative to a crankshaft within a cranktrain of an IC engine to vary a compression ratio of the internal combustion engine.

SUMMARY

A phasing mechanism for an internal combustion engine is provided that includes a stator, a rotor, a first plurality of rolling elements, a second plurality of rolling elements, a piston, and an optional bias spring. The rotor is configured to be rotated in a first rotational direction and a second rotational direction relative to the stator. The first plurality of rolling elements are configured to engage and move the rotor in the first rotational direction. The first plurality of rolling elements can include: i) a first plurality of inner rolling elements arranged radially between the piston and the rotor; and ii) a first plurality of outer rolling elements arranged radially between the piston and the stator. A second plurality of rolling elements are configured to engage and move the rotor in the second rotational direction. The second plurality of rolling elements can include: i) a second plurality of inner rolling elements arranged radially between the piston and the rotor; and ii) a second plurality of outer rolling elements arranged radially between the piston and the stator. The piston is configured to be hydraulically actuated in: i) a first axial direction to move the rotor in the first rotational direction; and ii) a second axial direction to move the rotor in the second rotational direction. The bias spring can have a first end attached to the stator and a second end attached to the piston. The bias spring can prevent relative rotation between the piston and the stator.

In an example embodiment: i) actuation of the piston in the first axial direction moves the first plurality of rolling elements so that the rotor moves in the first rotational direction; and ii) actuation of the piston in the second axial direction moves the second plurality of rolling elements so that the rotor moves in the second rotational direction.

In an example embodiment: i) the first plurality of rolling elements is configured to engage and roll on a first plurality of ramps arranged on the rotor to move or apply a torque to the rotor in the first rotational direction; and ii) the second plurality of rolling elements is configured to engage and roll on a second plurality of ramps arranged on the rotor to move or apply a torque to the rotor in the second rotational direction.

In an example embodiment the piston includes a third plurality of ramps and a fourth plurality of ramps. When the piston is hydraulically actuated in the first axial direction, the third plurality of ramps engages the first plurality of rolling elements so that the first plurality of rolling elements moves or applies a torque to the rotor in the first rotational direction. When the piston is hydraulically actuated in the second axial direction, the fourth plurality of ramps engages the second plurality of rolling elements so that the first plurality of rolling elements moves or applies a torque to the rotor in the second rotational direction.

In an example embodiment, the first, second, third, fourth, fifth, and sixth pluralities of ramps are helical surfaces.

In an example embodiment, each of the inner and outer ramp plates is formed from one piece via bending of sheet metal.

In an example embodiment, the phasing mechanism includes a hydraulic fluid control valve (HFCV) that is configured to attach the rotor to a shaft of an internal combustion engine. The HFCV includes a spool configured to move to one of a plurality of axial positions to hydraulically actuate the piston in the first and second axial directions.

In an example embodiment, the first ramp of the piston is formed within a first pocket arranged on an outer diameter of the piston, and the second ramp of the piston is formed within a second pocket arranged on an outer diameter of the piston. The second pocket is circumferentially separated from the first ramp.

In an example embodiment, the rotor can further comprise a locking pin configured to lock the rotor to the piston.

BRIEF DESCRIPTION OF THE DRAWINGS

The foregoing Summary will be best understood when read in conjunction with the appended drawings. In the drawings.

DETAILED DESCRIPTION

Figure 1:
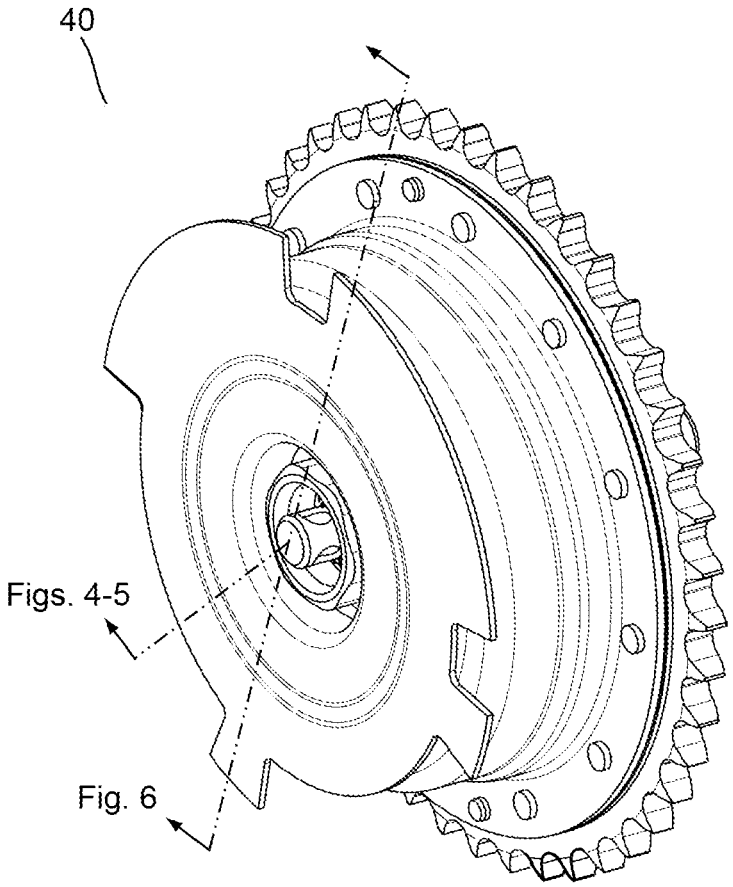
FIG. 1 is a perspective view of an example embodiment of a phasing mechanism with roller ramps together with a hydraulic fluid control valve (HFCV).
Figure 2:
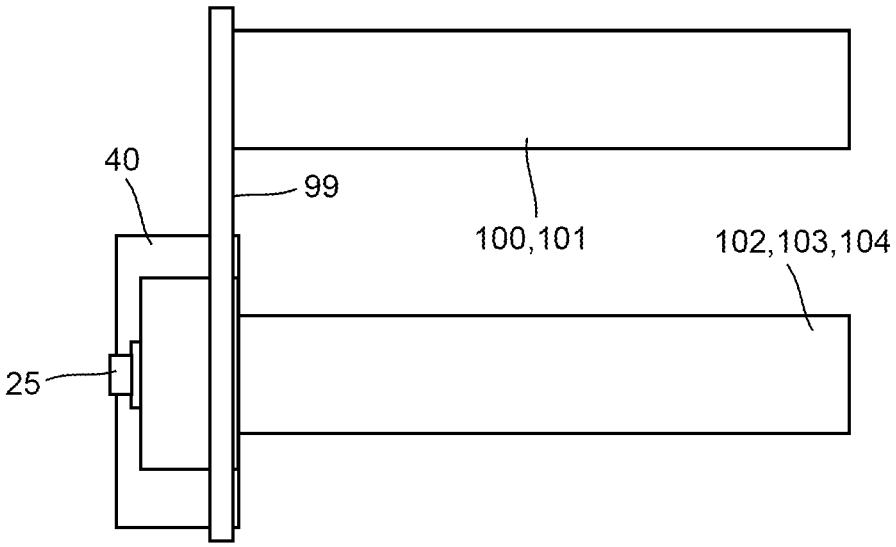
FIG. 2 is a schematic view of the phasing mechanism of FIG. 1 attached to a shaft, such as a camshaft or a shaft of a cranktrain of an internal combustion (IC) engine.
Figure 3:
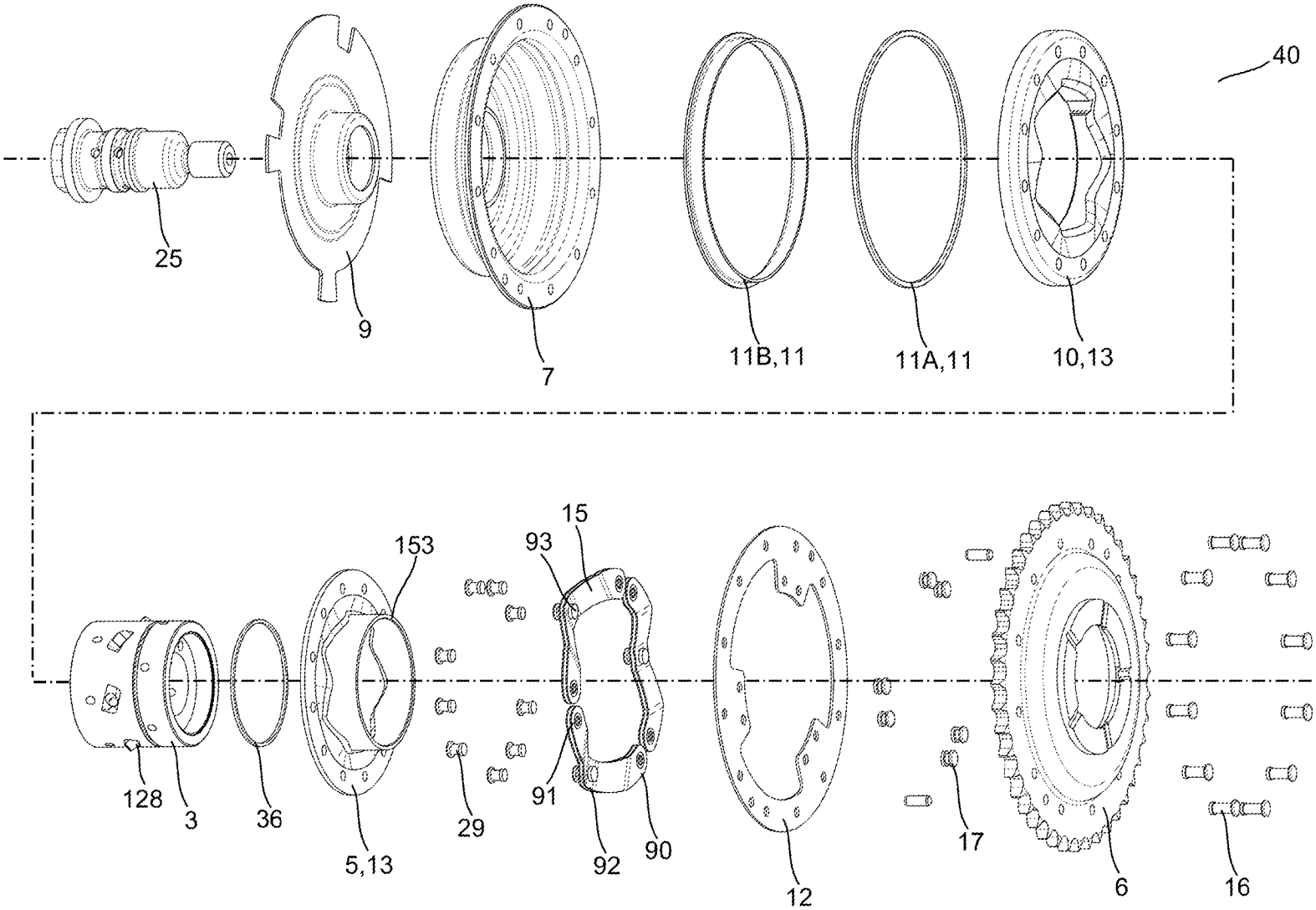
FIG. 3 is an exploded perspective view of the phasing mechanism and HFCV of FIG. 1.
Figure 4:
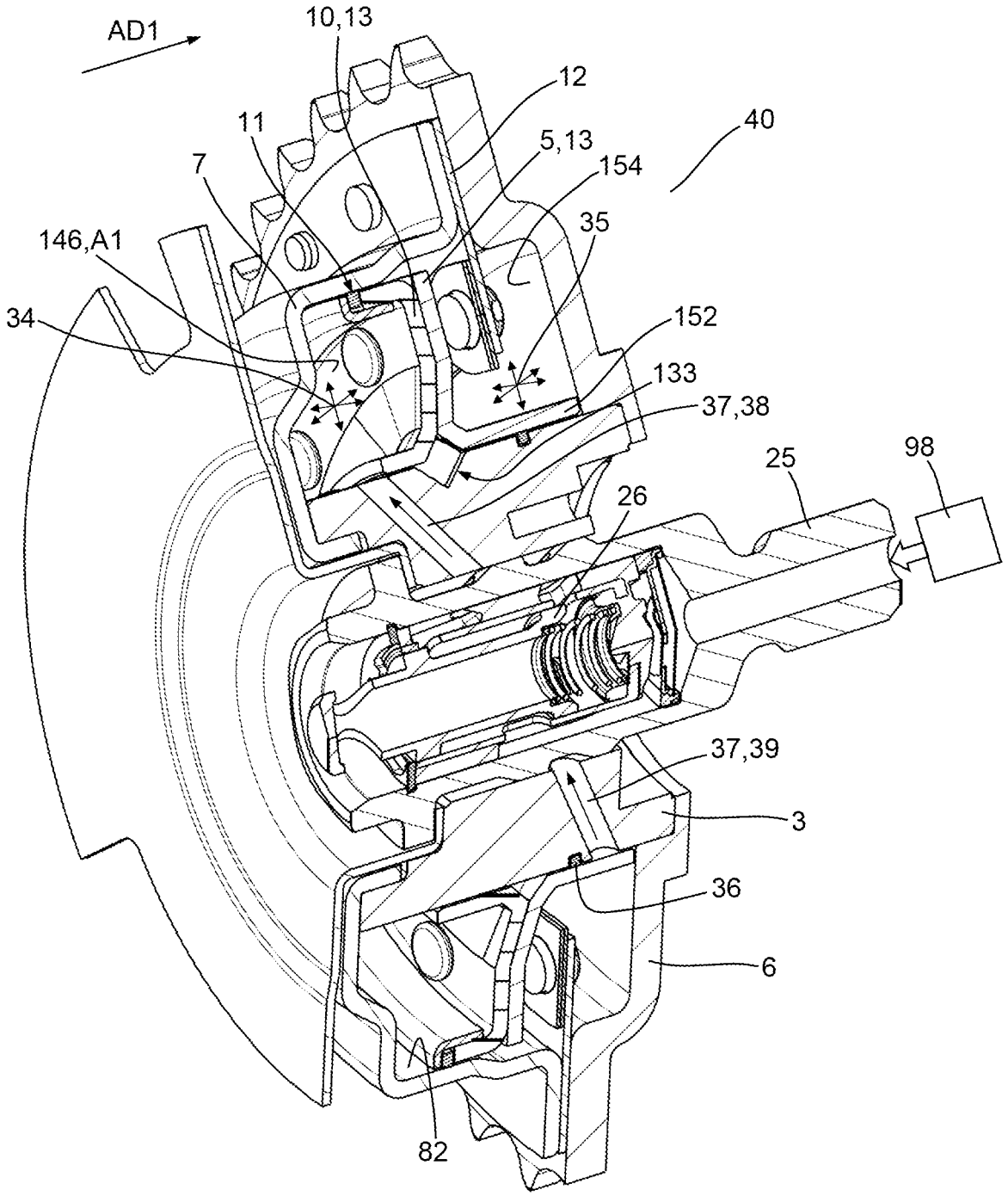
FIG. 4 is a cross-sectional perspective view of the phasing mechanism of FIG. 1 with the HFCV in a first extended position.
Figure 5:
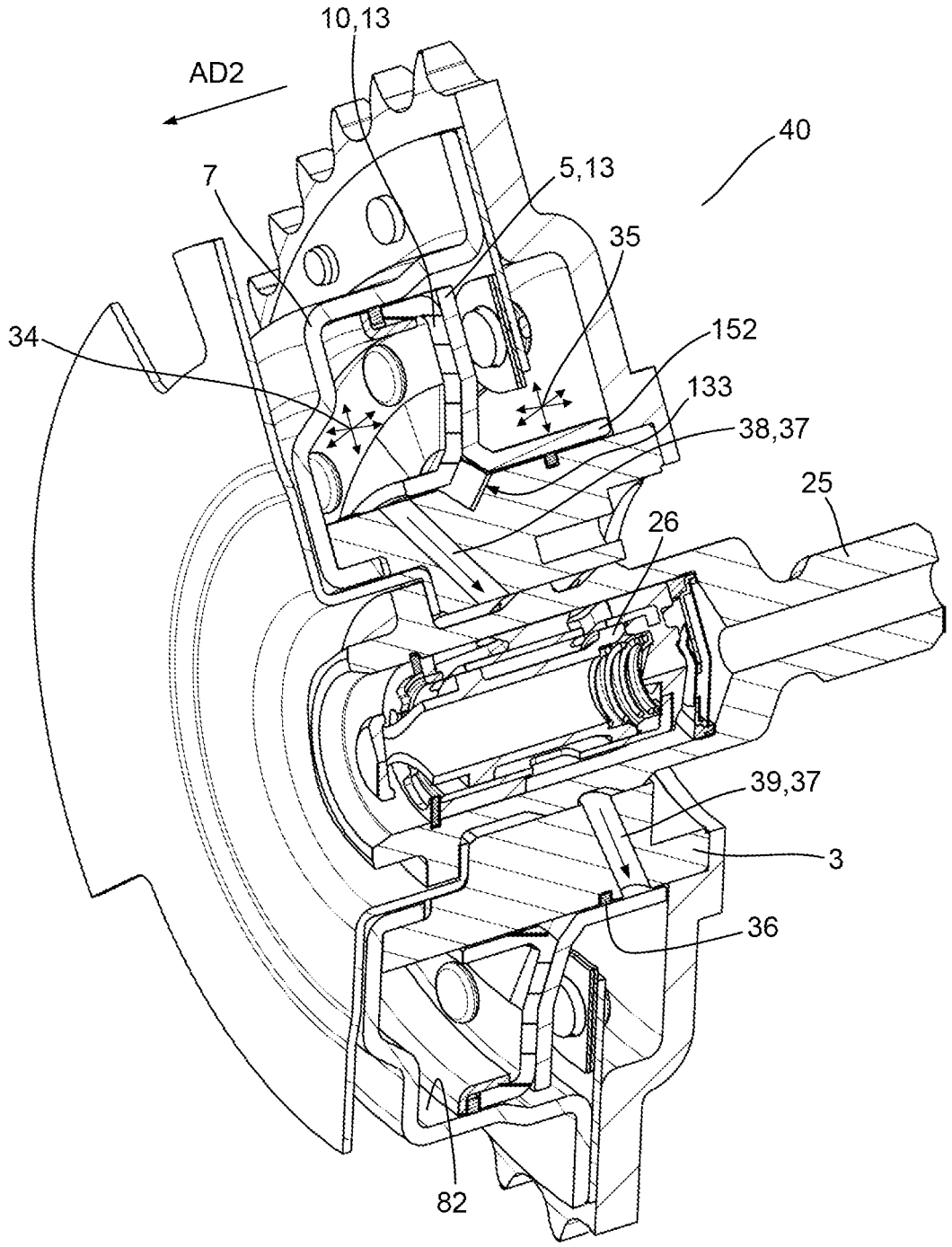
FIG. 5 is a cross-sectional perspective view of the phasing mechanism of FIG. 1 with the HFCV in a second compressed position.
Figure 6:
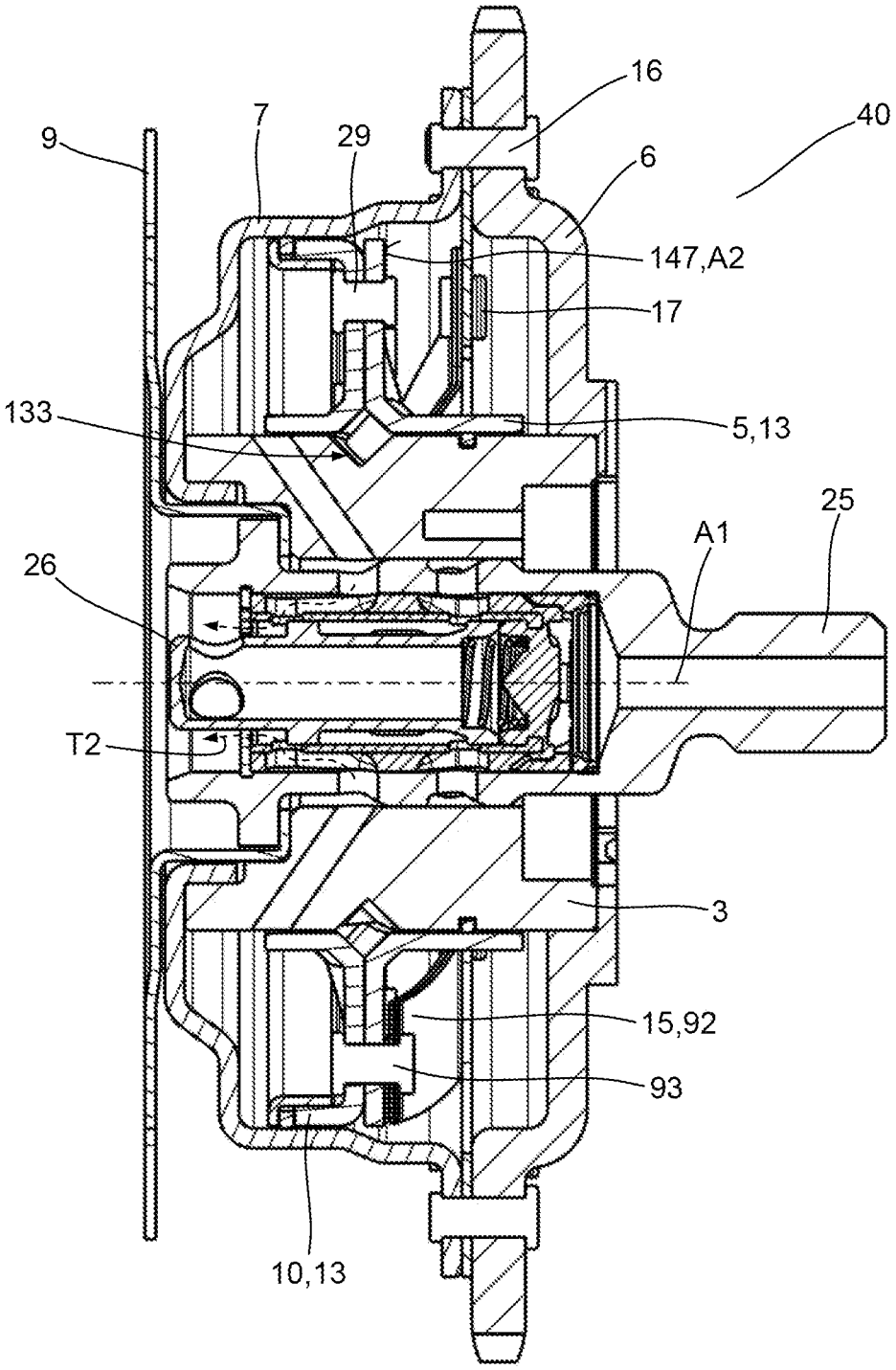
FIG. 6 is a cross-sectional view of the phasing mechanism of FIG. 1 with the HFCV in the second compressed position.
Figure 7A:
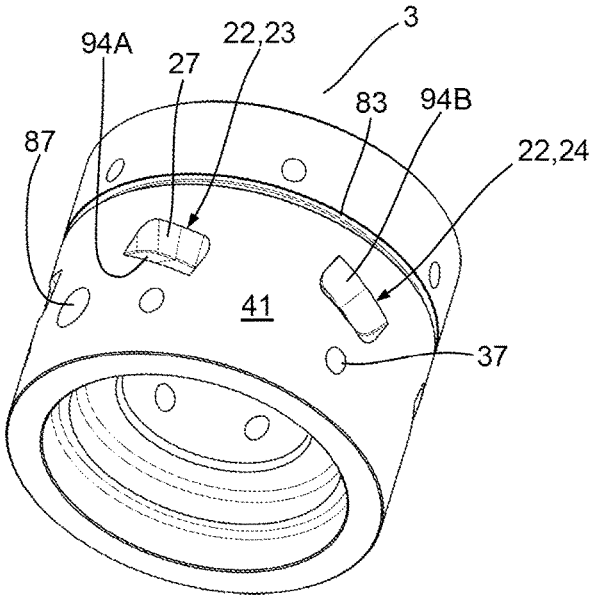
FIG. 7A is a first perspective view of a rotor for the phasing mechanism of FIG. 1.
Figure 7B:
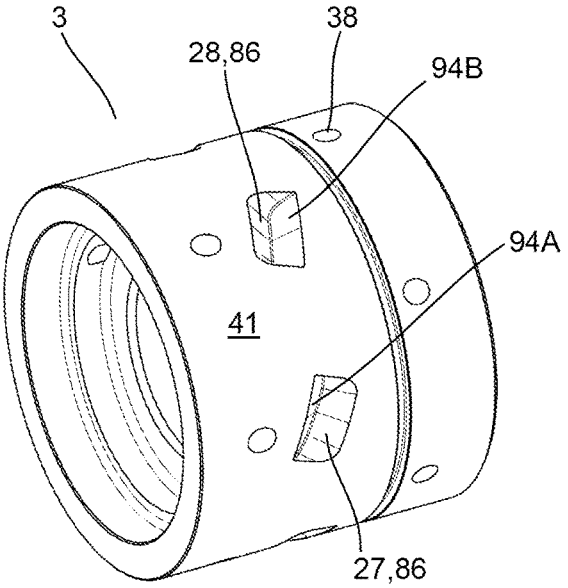
FIG. 7B is a second perspective view of the rotor for the phasing mechanism of FIG. 1.
Figure 8:
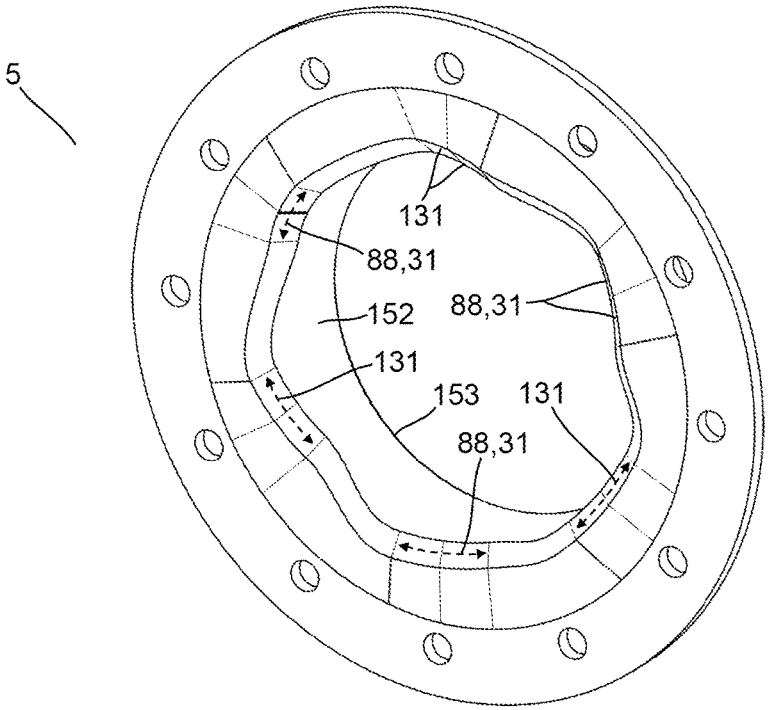
FIG. 8 is a perspective view of an inner ramp plate for the phasing mechanism of FIG. 1.
Figure 9:
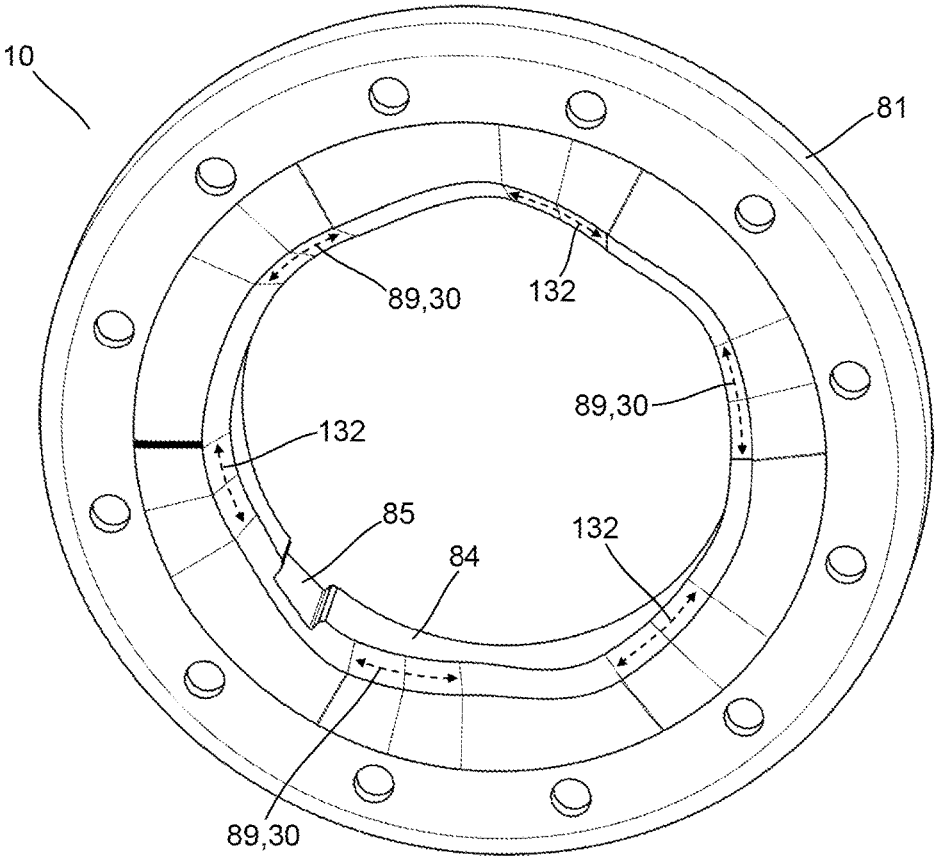
FIG. 9 is a perspective view of an outer ramp plate for the phasing mechanism of FIG. 1.
Figure 10A:
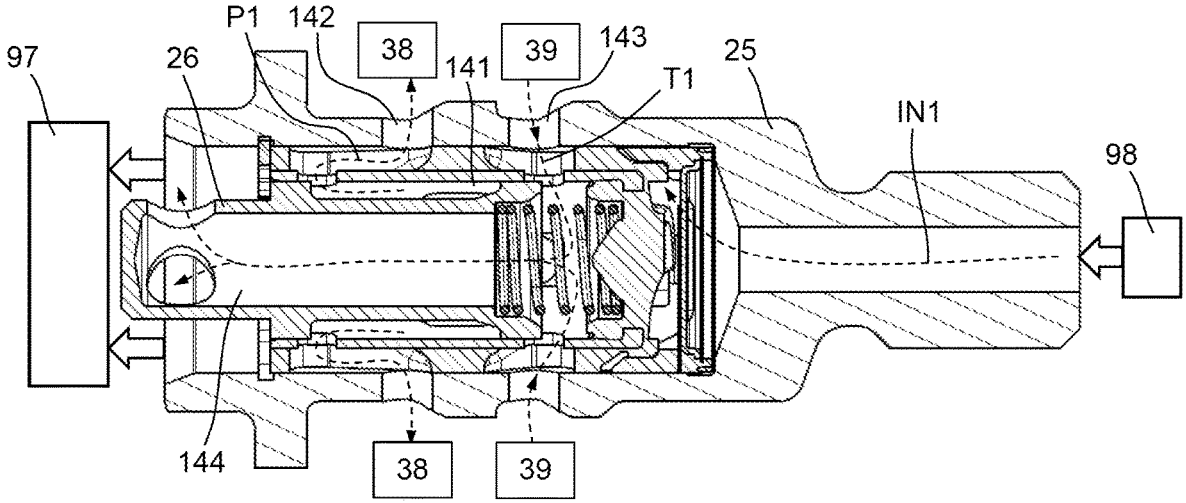
FIG. 10A is a cross-sectional view of the HFCV of FIG. 1 in the first extended position.
Figure 10B:
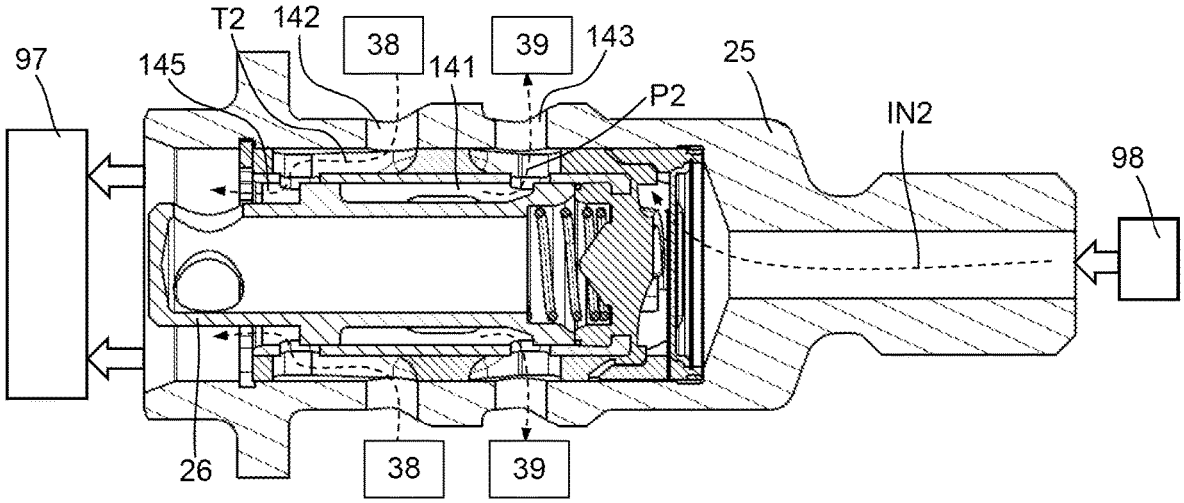
FIG. 10B is a cross-sectional view of the HFCV of FIG. 1 in the second compressed position.
Figure 11A:
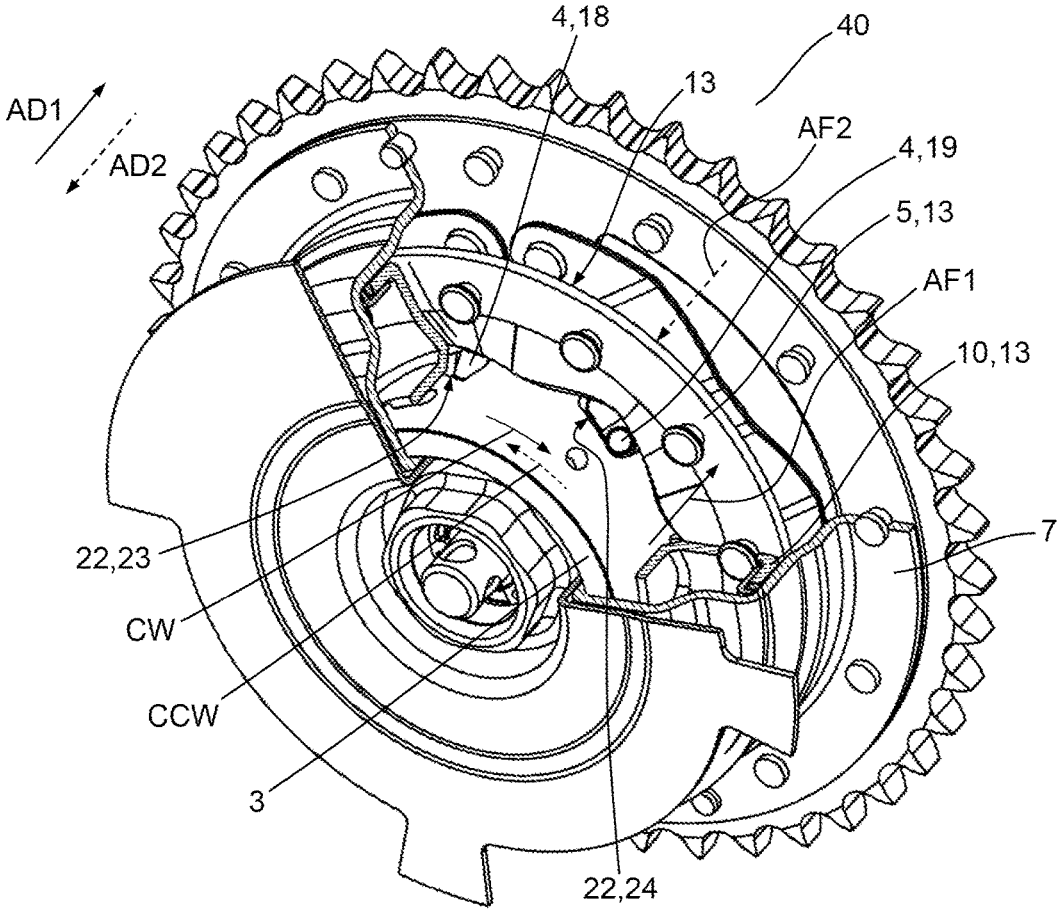
FIGS. 11A through 11C are partially sectioned perspective views that show successive phasing stages of the phasing mechanism of FIG. 1.
Figure 11B:
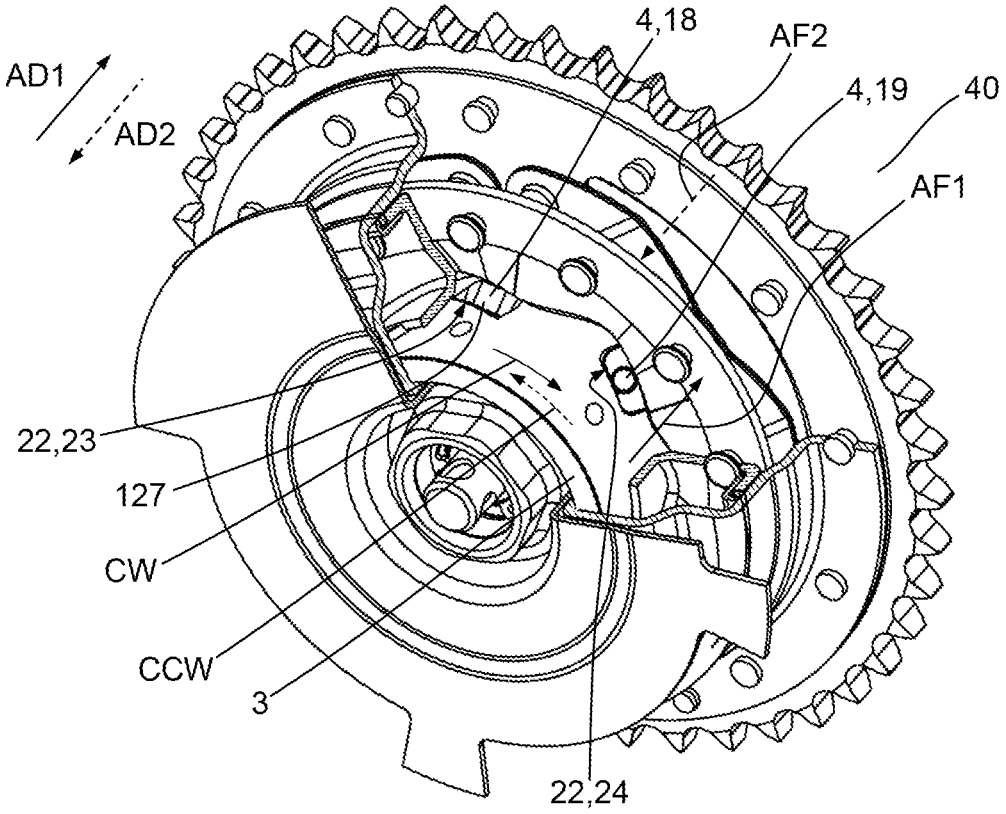
Figure 11C:
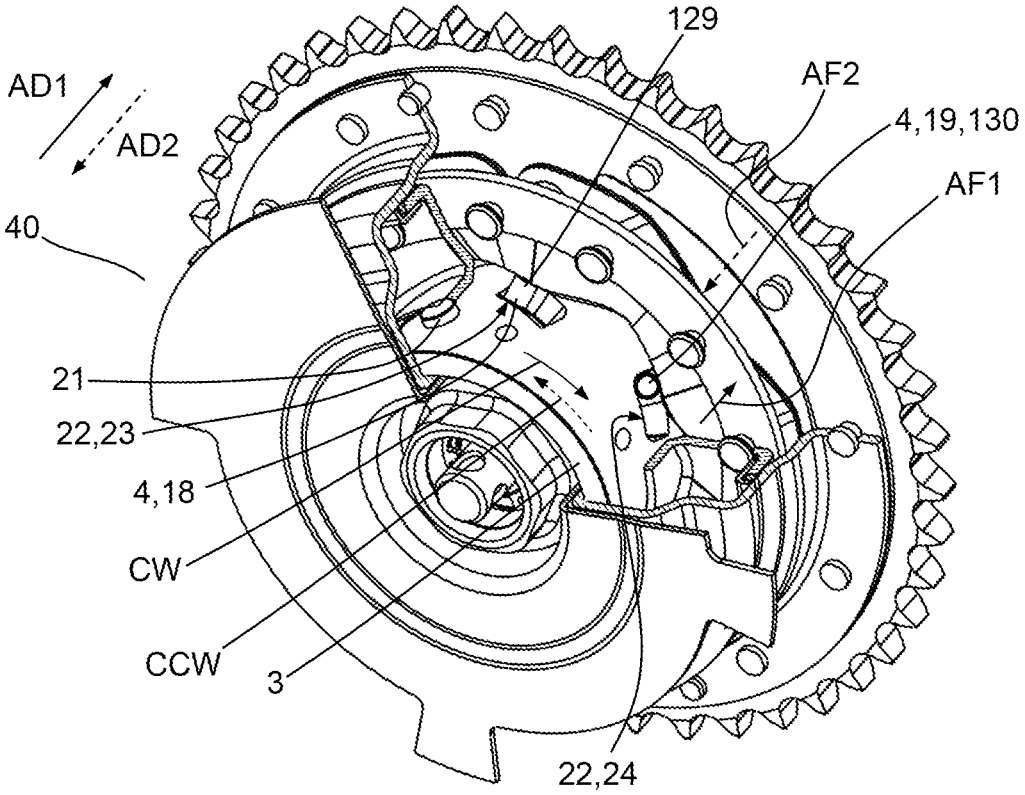
Figure 12:
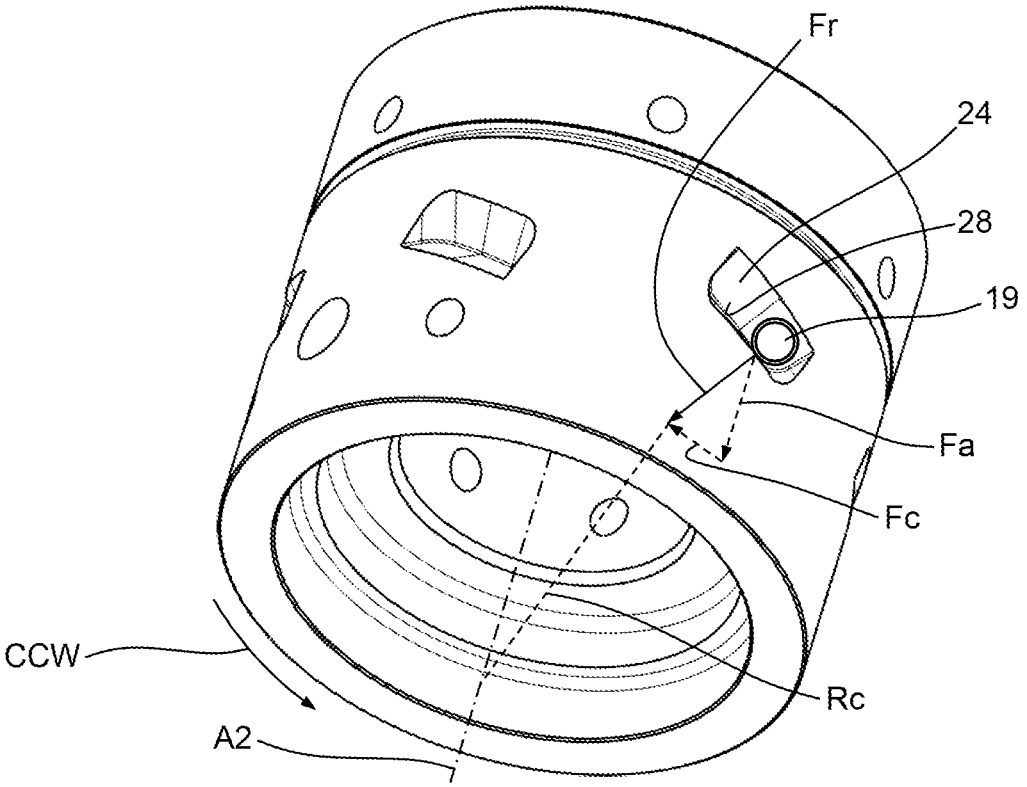
FIG. 12 shows the first perspective view of the rotor of FIG. 7A together with a rolling element and corresponding force vectors.

FIG. 1 is a perspective view of an example embodiment of a phasing mechanism 40 with roller ramps together with a hydraulic fluid control valve 25 (HFCV). FIG. 2 is a schematic view of the phasing mechanism 40 of FIG. 1 attached to a shaft 102, such as a camshaft 103 or a shaft 104 of a cranktrain of an internal combustion (IC) engine. FIG. 3 is an exploded perspective view of the phasing mechanism 40 and HFCV 25 of FIG. 1. FIG. 4 is a cross-sectional perspective view of the phasing mechanism 40 of FIG. 1 with the HFCV 25 in a first extended position. FIG. 5 is a cross-sectional perspective view of the phasing mechanism 40 of FIG. 1 with the HFCV 25 in a second compressed position. FIG. 6 is a cross-sectional view of the phasing mechanism 40 of FIG. 1 with the HFCV 25 in the second compressed position. FIG. 7A is a first perspective view of a rotor 3 of the phasing mechanism 40 of FIG. 1. FIG. 7B is a second perspective view of the rotor 3 of the phasing mechanism 40 of FIG. 1. FIG. 8 is a perspective view of an inner ramp plate 5 of the phasing mechanism 40 of FIG. 1. FIG. 9 is a perspective view of an outer ramp plate 10 of the phasing mechanism 40 of FIG. 1. FIG. 10A is a cross-sectional view of the HFCV 25 of FIG. 1 in the first extended position. FIG. 10B is a cross-sectional view of the HFCV 25 of FIG. 1 in the second compressed position. FIGS. 11A through 11C are partially sectioned perspective views that show successive phasing states of the phasing mechanism 40 of FIG. 1. FIG. 12 shows the first perspective view of the rotor 3 of FIG. 7A together with a rolling element 4 and corresponding force vectors. The following description should be read in light of FIGS. 1 through 12.

The phasing mechanism 40 includes the rotor 3, a stator 6, the inner ramp plate 5, the outer ramp plate 10, a stator cover 7, and a timing wheel 9. The stator 6 is configured to be drivably connected to a first shaft 100 of an IC engine, such as a crankshaft 101, via a drive chain 99 that engages a sprocket 8 on the stator 6; however, the stator 6 could also be drivably connected to the crankshaft 101 via a drive belt that engages a belt interface on the stator 6. Other suitable means of drivably connecting the stator 6 to the first shaft 100 or crankshaft 101 are also possible. The rotor 3 is configured to be fixed to a second shaft 102 of an IC engine so that when the rotor 3 rotates, the second shaft 102 rotates together and in unison with the rotor 3. The rotor 3 can be fixed to the second shaft 102 via the HFCV 25, as shown in the Figures, or by any other suitable fastening means. Relative clockwise or counterclockwise rotation between the rotor 3 and the stator 6 phases the second shaft 102 relative to the first shaft 100. When the second shaft 102 is a camshaft 103, relative clockwise or counterclockwise rotation between the rotor 3 and the stator 6 can change a valve timing of the IC engine. When the second shaft 102 is an eccentric shaft 104 of a cranktrain of an IC engine, relative clockwise or counterclockwise rotation between the rotor 3 and the stator 6 can change a compression ratio of the IC engine.

The phasing mechanism 40 utilizes an axial piston 13 that is configured to convert an axial force, a resultant of a pressurized hydraulic fluid acting on an axial face of the axial piston 13, to a torque applied to the rotor 3 to phase the second shaft 102 relative to the first shaft 100. The axial piston 13, as shown in the Figures, is formed by the inner ramp plate 5 and outer ramp plate 10, each of which could be produced from a single sheet metal piece via a stamping process or any suitable metal bending process; however, the axial piston 13 could also be formed by one piece, possibly stamped also, that incorporates the features of the inner ramp plate 5 and the outer ramp plate 10. Within the Figures, the inner ramp plate 5 is secured to the outer ramp plate 10 via rivets 29, however, other suitable means of attaching or joining the inner ramp plate 5 to the outer ramp plate 10 are possible.

A first resultant axial force AF1 applied to the axial piston 13 results when a pressurized hydraulic fluid from a pressurized hydraulic fluid source 98 acts on a first axial face 146 of the axial piston 13 (see FIG. 4). Assuming that the pressurized hydraulic fluid has a pressure Pr1 and the first axial face 146 has an effective axial surface area A1, the magnitude of the first resultant axial force AF1 is a product of Pr1×A1.

Likewise, a second resultant axial force AF2 applied to the axial piston 13 results when a pressurized hydraulic fluid from the pressurized hydraulic fluid source 98 acts on a second axial face 147 of the axial piston (see FIG. 6). Assuming that the pressurized hydraulic fluid has a pressure Pr1 and the second axial face 147 has an effective axial surface area A2, the magnitude of the second resultant axial force AF2 is a product of Pr1×A2.

The HFCV 25 is fluidly connected to the pressurized hydraulic fluid source 98, such as an oil pump, and controls delivery of hydraulic fluid to and from the phasing mechanism 40. The HFCV 25 includes a spool 26 that is actuated by a known electronically controlled actuator. Axial movement of the spool 26 can change delivery of the pressurized hydraulic fluid within a network of fluid galleries 37 arranged within the rotor 3.

The cross-sectional perspective view of FIG. 4 shows the HFCV 25 in the first extended position, or, more precisely, a first extended position of the spool 26. FIG. 10A is a cross-sectional view of the HFCV 25 that shows corresponding hydraulic fluid pathways with the spool 26 in the first extended position. In this first extended position: i) a first gallery 38 of the rotor 3 receives pressurized hydraulic fluid, or, alternatively stated, the first gallery 38 is fluidly connected to the pressurized hydraulic fluid source 98 via the HFCV 25; and, ii) a second gallery 39 is depressurized via its connection to "tank", or to a hydraulic fluid sump 97 via the HFCV 25. In the first extended position of the HFCV 25, movement of the axial piston 13 occurs in a first axial direction AD1 within FIG. 4 due to pressurization of a first hydraulic actuation chamber 34 via the first gallery 38 and a depressurization of a second hydraulic actuation chamber 35 via the second gallery 39.

Referring to FIG. 10A, the pressurization of the first gallery 38 occurs when a hydraulic fluid connection between an outer annulus 141 of the spool 26 and the first gallery 38 of the rotor 3 is enabled by the first extended position of the spool 26. The outer annulus 141 is pressurized via its hydraulic fluid connection to an inlet hydraulic fluid pathway IN1. The specific pathway(s) that facilitate the hydraulic fluid connection between the outer annulus 141 and the inlet hydraulic fluid pathway IN1 is/are not shown within the cross-sectional view of FIG. 10A, but such pathways are prevalent within known HFCVs and thus further discussion is not needed. A first pressurized hydraulic fluid pathway P1 extends from the outer annulus 141 to a first fluid port 142 that is fluidly connected to the first gallery 38 of the rotor.

Depressurization of the second gallery 39 occurs when the second gallery 39 is fluidly connected to an inner chamber 144 of the spool 26 via a first tank pathway T1 that extends through a second fluid port 143 of the HFCV 25. The inner chamber is fluidly connected to "tank" or the hydraulic fluid sump 97.

The first hydraulic actuation chamber 34 is fluidly connected to the first gallery 38 of the rotor 3 and is formed or defined by an outer radial surface 41 of the rotor 3, the stator cover 7, the outer ramp plate 10, and a seal assembly 11 that is fixed to an outer rim 81 of the outer ramp plate 10. The seal assembly 11 slidably forms a seal with a radial inner surface 82 of the stator cover 7 and includes an elastomer seal 11A and a retaining ring 11B.

The second hydraulic actuation chamber 35 is fluidly connected to the second gallery 39 of the rotor 3 and is formed or defined by the outer radial surface 41 of the rotor 3, the stator cover 7, and the inner ramp plate 5. A rotor seal 36 is disposed within a groove 83 arranged on the outer radial surface 41 of the rotor 3. The inner ramp plate 5 slidably forms a seal with the rotor seal 36 as the axial piston 13 is actuated in either of the first or second axial directions AD1, AD2.

The cross-sectional perspective view of FIG. 5 shows the HFCV 25 in the second compressed position, or, more precisely, a second compressed position of the spool 26. FIG. 10B is a cross-sectional view of the HFCV 25 that shows corresponding hydraulic fluid pathways with the spool 26 in the second compressed position. In this second compressed position: i) the second gallery 39 of the rotor 3 receives pressurized hydraulic fluid, or, alternatively stated, the second gallery 39 is fluidly connected to the pressurized hydraulic fluid source 98 via the HFCV 25; and, ii) the first gallery 38 is depressurized via its connection to "tank", or to a hydraulic fluid sump 97 via the HFCV 25. In the second compressed position of the HFCV 25, movement of the axial piston 13 occurs in the second axial direction AD2 within FIG. 5 due to pressurization of the second hydraulic actuation chamber 35 via the second gallery 39 and a depressurization of the first hydraulic actuation chamber 34 via the first gallery 38.

Referring to FIG. 10B, the pressurization of the second gallery 39 occurs when a hydraulic fluid connection between an outer annulus 141 of the spool 26 and the second gallery 39 of the rotor 3 is enabled by the second compressed position of the spool 26. The outer annulus 141 is pressurized via its hydraulic fluid connection to an inlet hydraulic fluid pathway IN2. The specific pathway(s) that facilitate the hydraulic fluid connection between the outer annulus 141 and the inlet hydraulic fluid pathway IN2 is/are not shown within the cross-sectional view of FIG. 10B, but such pathways are prevalent within known HFCVs and thus further discussion is not needed. A second pressurized hydraulic fluid pathway P2 extends from the outer annulus 141 to a second fluid port 143 that is fluidly connected to the second gallery 39 of the rotor.

Depressurization of the first gallery 38 occurs when the first gallery 38 is fluidly connected to a vented outer annulus 145 of the spool 26 via a second tank pathway T2 that extends through the first fluid port 142 of the HFCV 25. The vented outer annulus 145 is fluidly connected to "tank" or the hydraulic fluid sump 97.

Referring to FIGS. 7A, 11C and 9, the rotor 3 includes a locking pin bore 87 for a locking pin 21 and a locking pin bias spring (not shown) that pushes the locking pin 21 radially outward into a channel 85 arranged on an inner rim 84 of the outer ramp plate 10. Locking of the rotor 3 to the outer ramp plate 10 may be necessary when adequate hydraulic fluid pressure is not available (such as during an engine start-up condition) to maintain a stable axial position of the axial piston 13.

The conversion of axial or linear motion of the axial piston 13 to rotary motion of the rotor 3 occurs via rolling elements 4 that engage and roll onto ramps 86 formed within rotor pockets 22. The rolling elements 4 forcibly engage and roll on the ramps 86 of the rotor 3 via ramps 88 formed within the inner ramp plate 5 and ramps 89 formed within the outer ramp plate 10. The ramps 88, 89 of the respective inner and outer ramp plates 5, 10 forcibly engage the rolling elements 4 due to the axial force AF1 applied to the axial piston 13 caused by pressurization of one of the respective first or second hydraulic actuation chambers 34, 35. For the purpose of this disclosure, the term "ramp" is meant to signify a feature or form that defines a sloping surface that can translate axial motion into rotational motion. The aforementioned ramps 86, 88, 89 can be helical in form, defining a surface that is curved in three-dimensions; however, other ramp forms are possible.

Amongst the rolling elements 4, a first group of rolling elements 18 is disposed within a first group of rotor pockets 23. A second group of rolling elements 19 is disposed within a second group of rotor pockets 24. The first and second groups of rotor pockets 23, 24 are angled in a helical configuration and dispersed in an alternating pattern around the circumference of the rotor 3, however other forms and patterns are also possible. When the axial piston 13 moves in the first axial direction AD1, the first group of rolling elements 18 can roll against a first ramp 27 arranged within each of the first group of rotor pockets 23; this rolling incidence is initiated by engagement of the first group of rolling elements 18 by third ramps 30 arranged within the outer ramp plate 10 when the outer ramp plate 10 is actuated by pressurized hydraulic fluid.

The partially sectioned perspective views of FIGS. 11A through 11C, which have a portion of the stator cover 7 and the outer ramp plate 10 removed, can provide further clarity of the relative movements of the axial piston 13, rotor 3 and rolling elements 4.

When viewed in successive order, FIGS. 11A through 11C show relative movement of the axial piston 13 in the first axial direction AD1 (due to the presence of the first resultant axial force AF1), which results in rotational movement of the rotor 3 in a clockwise direction CW. The directional arrows of the first axial force AF1, the first axial direction AD1, and the clockwise direction CW are drawn with solid lines as these three elements correspond to one another. FIG. 11A shows one of the first group of rolling elements 18 disposed within one of the first group of rotor pockets 23 at a first end of the first ramp 27. Due to the presence of the first resultant axial force AF1, the first group of rolling elements 18 are forcibly engaged with the first ramp 27 of the first group of rotor pockets 23 via the third ramps 30 arranged on the outer ramp plate 10. FIGS. 7A and 7B can be referenced for further clarity of the first ramp 27 within the first group of rotor pockets 23, and FIG. 9 can be referenced for further clarity of the third ramp 30 formed on the outer ramp plate 10. FIG. 11B shows that, due to the continued application of the first resultant axial force AF1, the one of the first group of rolling elements 18 has rolled to a further location on the first ramp 27, resulting in a clockwise rotation CW of the rotor 3 and axial displacement of the axial piston 13 in the first axial direction AD1. FIG. 11C shows that, due to the continued application of the first resultant axial force AF1, the one of the first group of rolling elements 18 has forcibly rolled further on the first ramp 27, resulting in additional clockwise rotation CW of the rotor 3 and further displacement of the axial piston 13 in the first axial direction AD1.

When the axial piston 13 moves in the second axial direction AD2, the second group of rolling elements 19 can roll against a second ramp 28 arranged within each of the second group of rotor pockets 24; this rolling incidence can be initiated by engagement of the second group of rolling elements 19 by fourth ramps 31 arranged within the inner ramp plate 5 when the inner ramp plate 5 is actuated by pressurized hydraulic fluid.

When viewed in reverse order, FIG. 11C→FIG. 11B→FIG. 11A, relative movement of the axial piston 13 in the second axial direction AD2 (due to the presence of the second resultant axial force AF2) is shown, which results in rotational movement of the rotor 3 in a counterclockwise direction CCW. The directional arrows of the second axial force AF2, the second axial direction AD2, and the counterclockwise direction CCW are drawn with broken lines as these three elements correspond to one another. FIG. 11C shows one of the second group of rolling elements 19 disposed within one of the second group of rotor pockets 24. Due to the presence of the second resultant axial force AF2, the second group of rolling elements 19 is forcibly engaged with the second ramp 28 of the first group of rotor pockets 23 via the fourth ramps 31 arranged on the inner ramp plate 5. FIGS. 7A and 7B can be referenced for further clarity of the second ramp 28 within the second group of rotor pockets 24, and FIG. 8 can be referenced for further clarity of the fourth ramps 31 formed on the inner ramp plate 5. FIG. 11B shows that, due to the continued application of the second resultant axial force AF2, the one of the second group of rolling elements 19 has rolled to a further location on the second ramp 28, resulting in a counterclockwise rotation CCW of the rotor 3 and axial displacement of the axial piston 13 in the second axial direction AD2. FIG. 11A shows that, due to the continued application of the second resultant axial force AF2, the one of the second group of rolling elements 19 has rolled further on the second ramp 28, resulting in additional counterclockwise rotation CCW of the rotor 3 and further displacement of the axial piston 13 in the second axial direction AD2.

In addition to the previously described first and second ramps 27, 28 that are arranged within each of the respective first and second groups of rotor pockets 23, 24, an axial abutment surface for each of the contained first and second groups of rolling elements 18, 19 also resides within each of the first and second group of rotor pockets 23, 24. FIGS. 7A-9 and FIGS. 11A-11C show: i) a first axial abutment surface 94A that is formed within each of the first group of rotor pockets 23; and ii) a second axial abutment surface 94B that is formed within each of the second group of rotor pockets 24. The first axial abutment surface 94A retains a first radially inner end 127 of the first group of rolling elements 18 and the second axial abutment surface 94B retains a first radially inner end 128 of the second group of rolling elements 19.

A second radially outer end 129 of the first group of rolling elements 18 is retained by a third axial abutment surface 131 formed within the inner ramp plate 5; and, a second radially outer end 130 of the second group of rolling elements 19 is retained or limited in axial movement by a fourth axial abutment surface 132 formed within the outer ramp plate 10.

The previously described first through fourth axial abutment surfaces 94A, 94B, 131, 132 can be helically shaped or formed like that of the corresponding helically formed ramps which define the pathways of the rolling elements 4. It could be stated that each of the first group of rolling elements 18 and the second group of rolling elements 19 are enclosed or encapsulated by two opposed ramp surfaces and two opposed axial abutment surfaces. Together, the two opposed ramp surfaces and the two opposed axial abutment surfaces form a helically shaped passageway within which the respective rolling elements roll. A cross-section of such an enclosed first helical passageway 133 for the first group of rolling elements 18 is shown in FIGS. 4 through 6.

Each of the ramps 86 of the rotor 3 are formed in a helical configuration to produce a rotational response to an axial input provided by the axial piston 13. FIG. 12 assumes shows a reaction force vector characteristic of the rotor 3 when one of the second group of rolling elements 19 forcibly rolls on the second ramp 28 within one of the second group of rotor pockets 24. A force Fr applied to the second ramp 28 by the rolling element has an axial component Fa and a circumferential component Fc. The circumferential component Fc acts at a distance Rc from the central axis A2 of the rotor 3 to create a resultant torque equal to the product of Fc×Rc that rotates the rotor 3 in the counterclockwise direction (CCW). An applied torque to the rotor 3 in the clockwise direction CW results when the first group of rolling elements 18 forcibly rolls against the first ramps 27 within the first group of rotor pockets 23.

A torque path from the first shaft 100 of the IC engine (such as the crankshaft 101) to the second shaft 102 of the IC engine (such as the camshaft 103 or the eccentric shaft 104) includes the following. The timing chain 99 applies torque to the sprocket 8 of the stator 6 causing the phasing mechanism 40 to rotate about a rotational axis AX1. A drive plate 12 is secured to the stator 6 and stator cover 7 via rivets 16. A first end 90 and a second end 91 of each of the leaf springs 15 are secured to the drive plate 12 via rivets 17. A middle portion 92 of the leaf springs 15 is secured to the inner and outer ramp plates 5, 10 via rivets 93. The leaf springs 15: i) facilitate axial movement of the axial piston 13; ii) provide an axial biasing force to the axial piston 13; and iii) prevent relative rotation between the axial piston 13 and the drive plate 12 which is fixed to the stator 6.

When neither of the first actuation chamber 34 or the second actuation chamber 35 are pressurized, such as during an IC engine shutdown condition, the leaf springs 15 can move the axial piston 13 in the first axial direction AD1 to a first axial stop position. This first axial stop position is achieved when an axial surface 153 (see FIG. 3) of an inner rim 152 of the inner ramp plate 5 abuts with an inner axial surface 154 of the stator 6 as shown in FIG. 4. Similarly, a second axial stop position for the axial piston 13 when moving in the second axial direction AD2 is achieved when the retaining ring 11B of the seal assembly 11 abuts with the stator cover 7.

Figure 13:
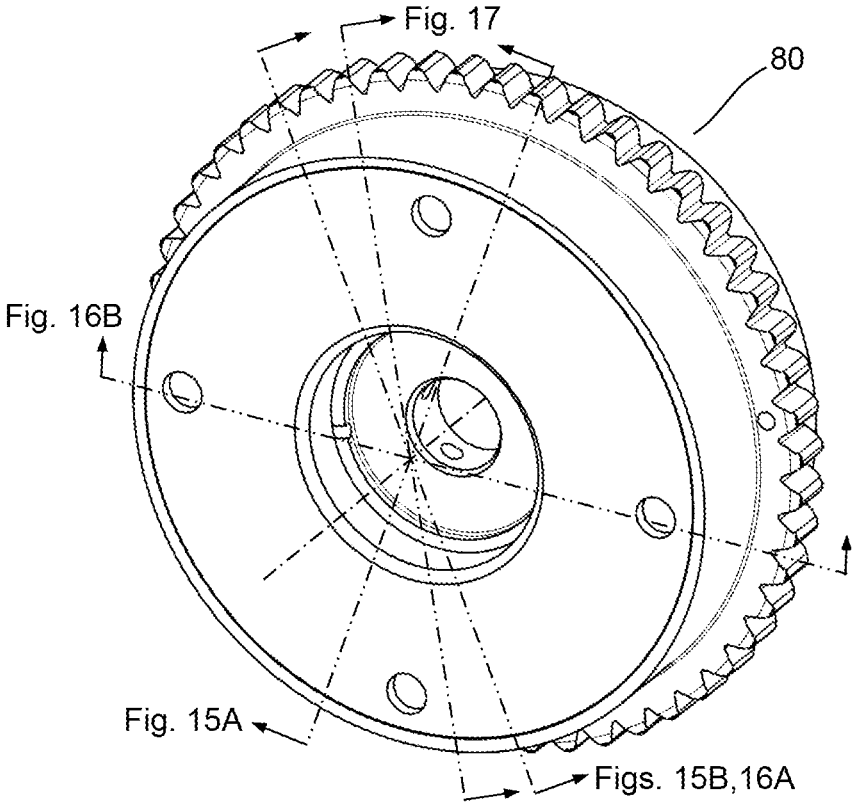
FIG. 13 is a perspective view of a phasing mechanism with roller ramps.
Figure 14:
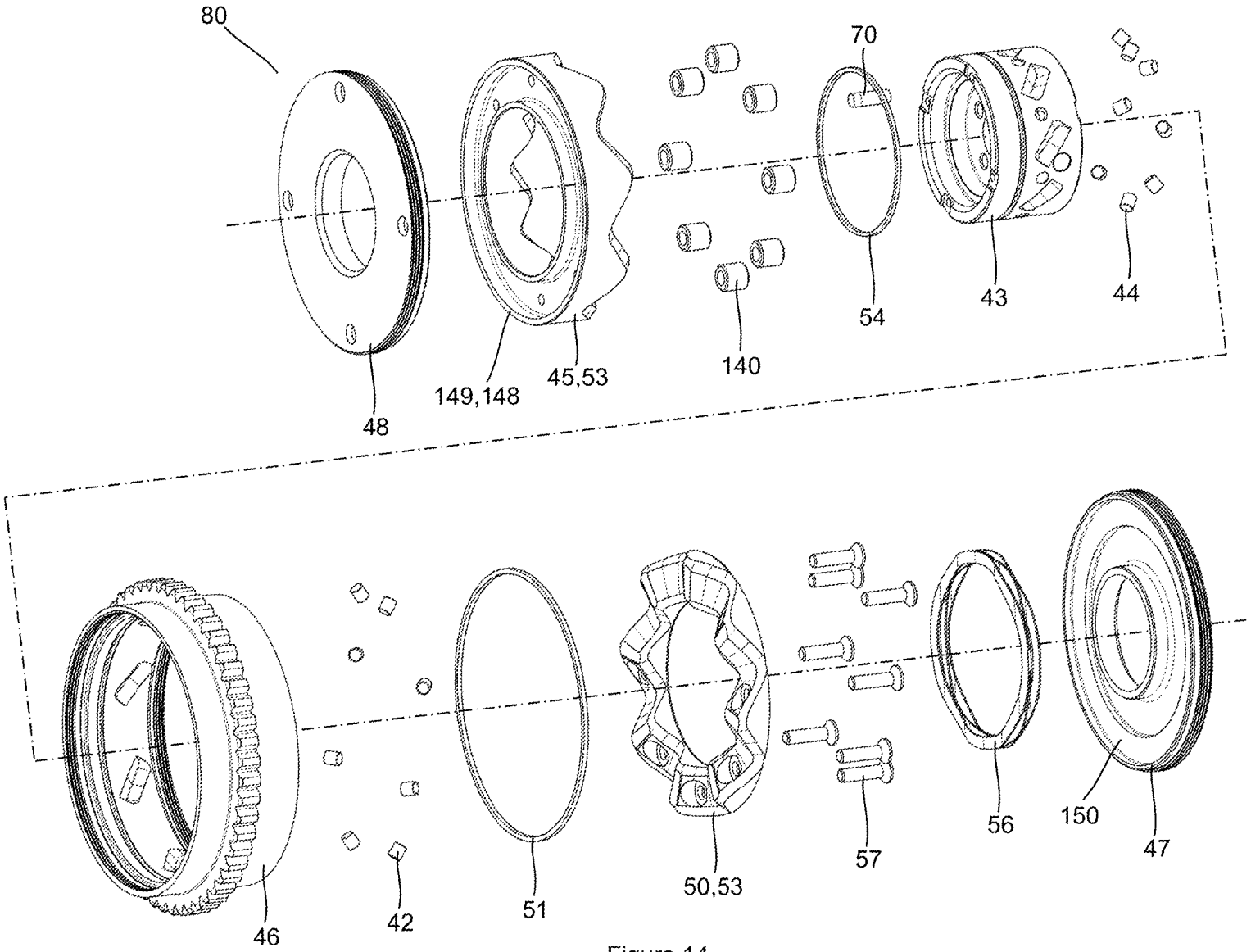
FIG. 14 is an exploded perspective view of the phasing mechanism of FIG. 13.
Figure 15A:
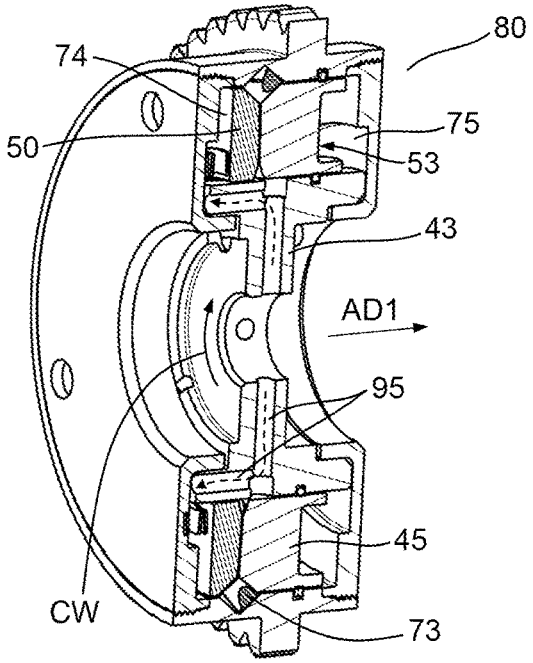
FIG. 15A is a cross-sectional view of the phasing mechanism of FIG. 13 that shows first hydraulic fluid pathways for adjusting the phasing mechanism in a clockwise direction relative to the stator.
Figure 15B:
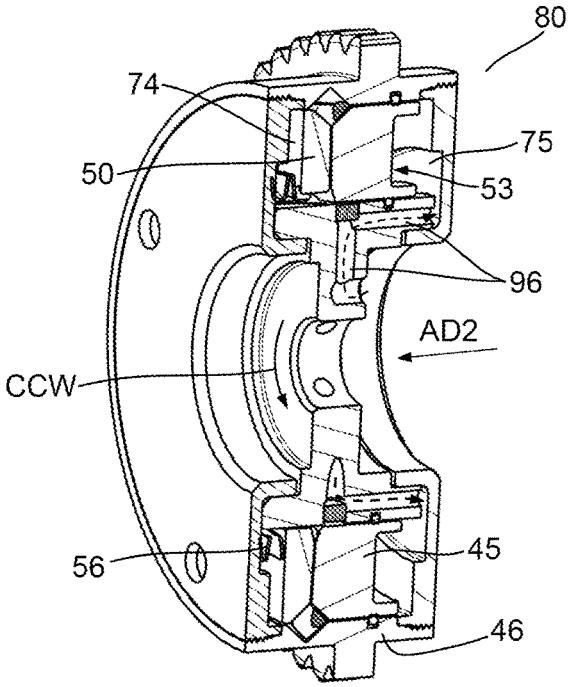
FIG. 15B is a cross-sectional view of the phasing mechanism of FIG. 13 that shows second hydraulic fluid pathways for adjusting the phasing mechanism in a counterclockwise direction relative to the stator.
Figure 16A:
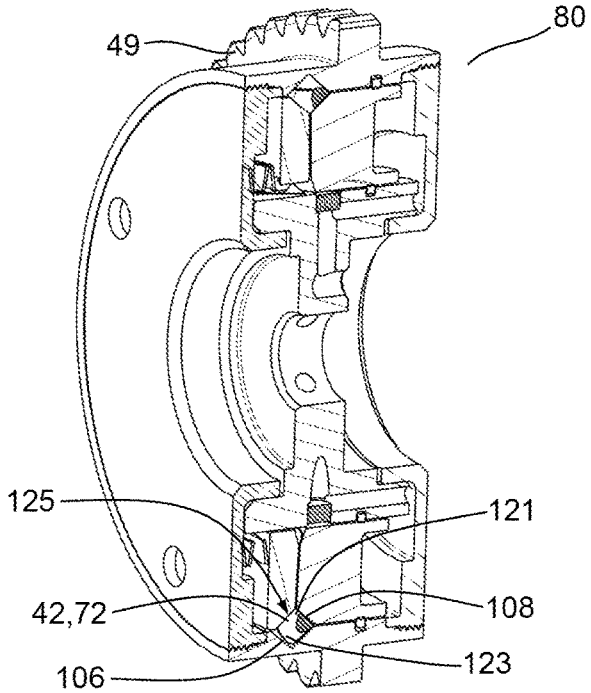
FIG. 16A is a cross-sectional view of the phasing mechanism of FIG. 13 that shows outer rolling elements.
Figure 16B:
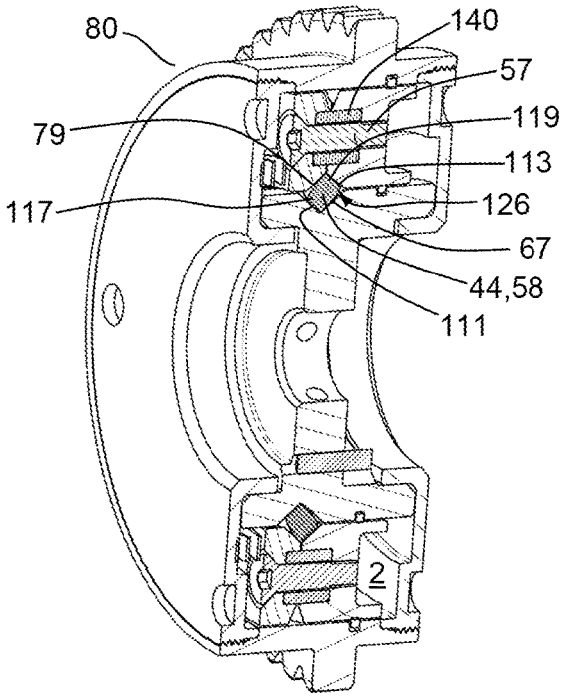
FIG. 16B is a cross-sectional view of the phasing mechanism of FIG. 13 that shows inner rolling elements.
Figure 17:
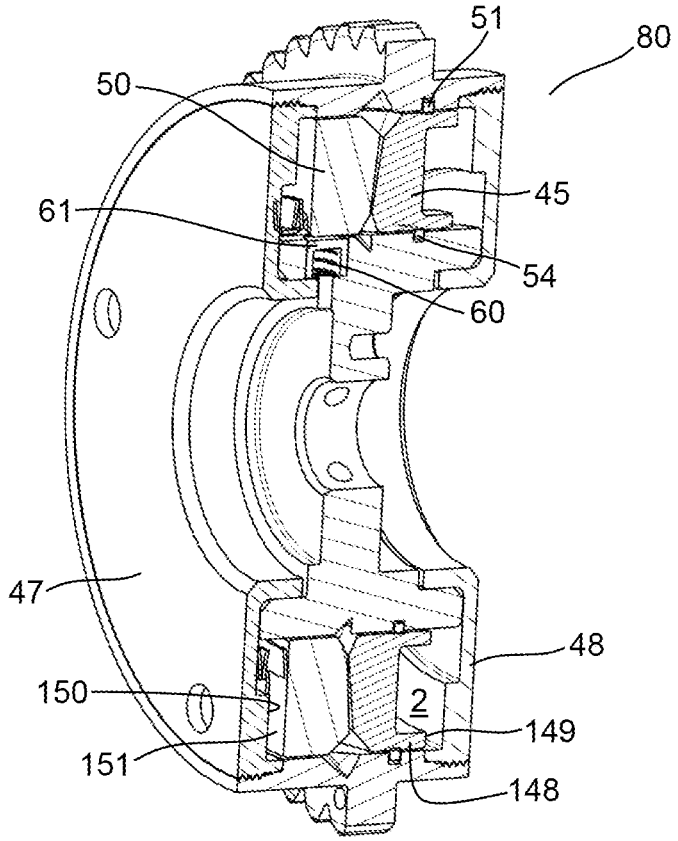
FIG. 17 is a cross-sectional view of the phasing mechanism of FIG. 13 that shows a locking pin and a locking pin bias spring.
Figure 18:
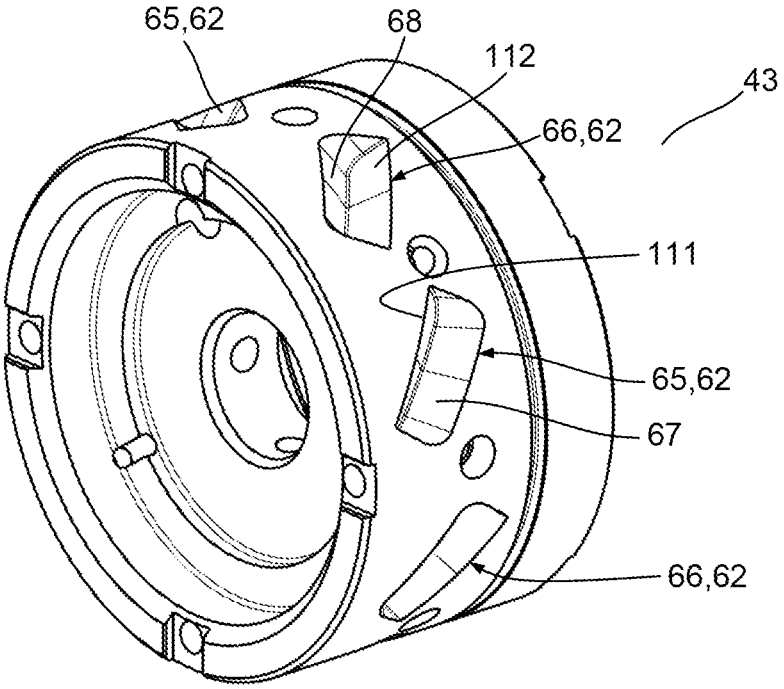
FIG. 18 is a perspective view of a rotor for the phasing mechanism of FIG. 13.
Figure 19:
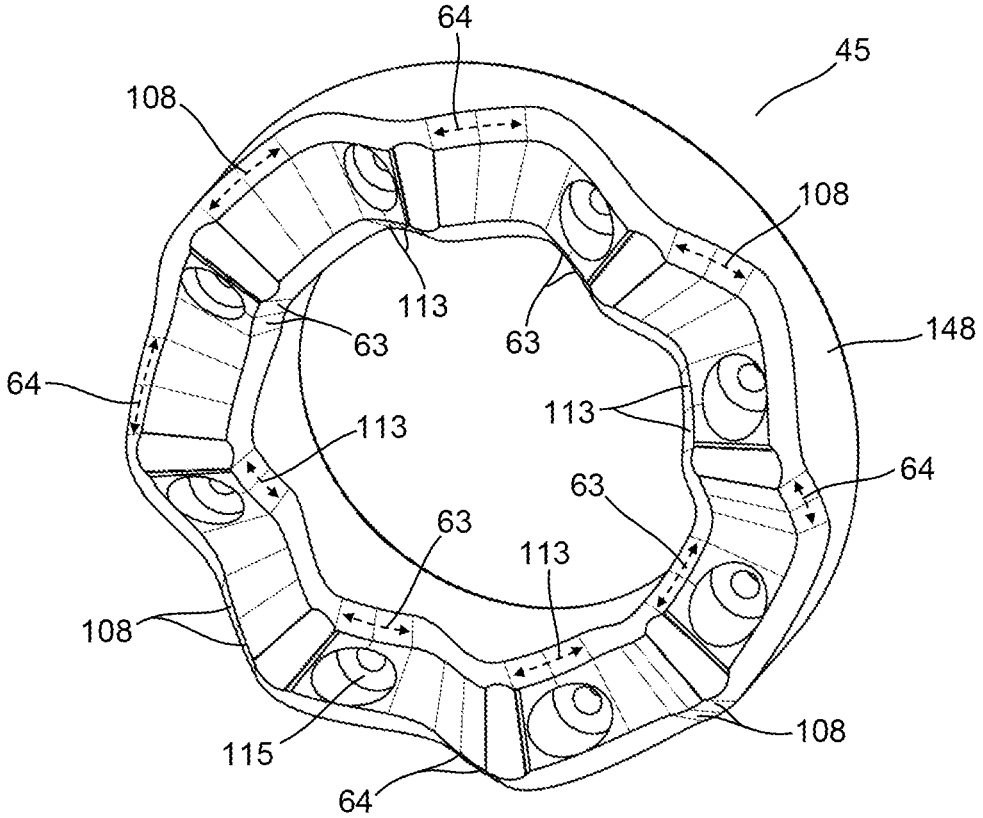
FIG. 19 is a perspective view of an inner ramp plate for the phasing mechanism of FIG. 13.
Figure 20:
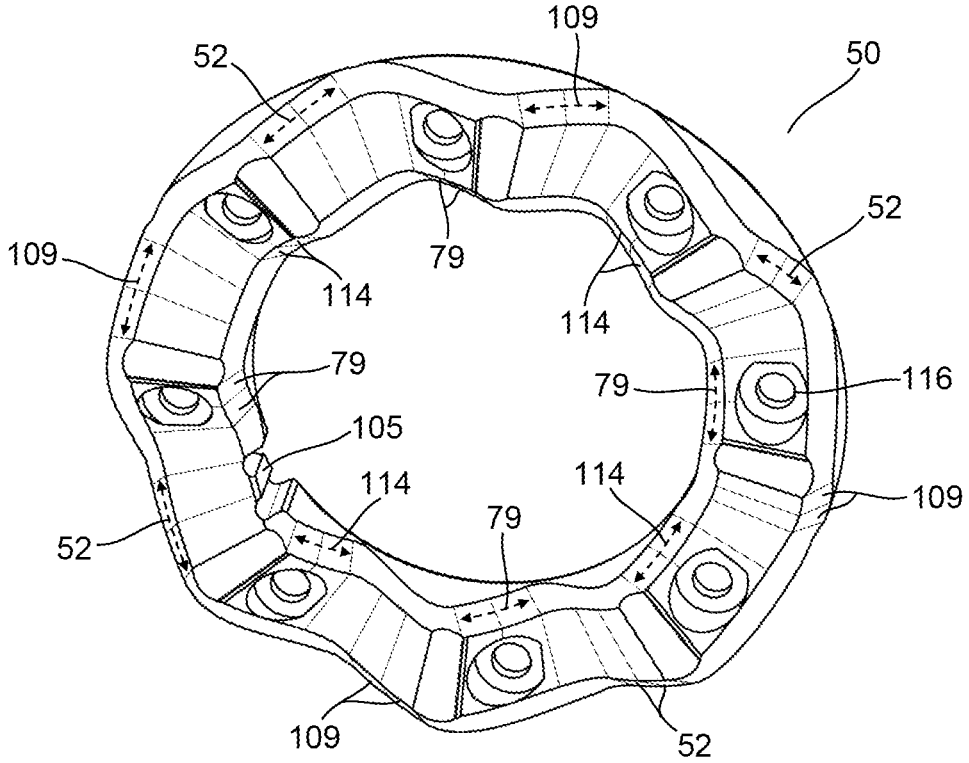
FIG. 20 is a perspective view of an outer ramp plate for the phasing mechanism of FIG. 13.
Figure 21A:
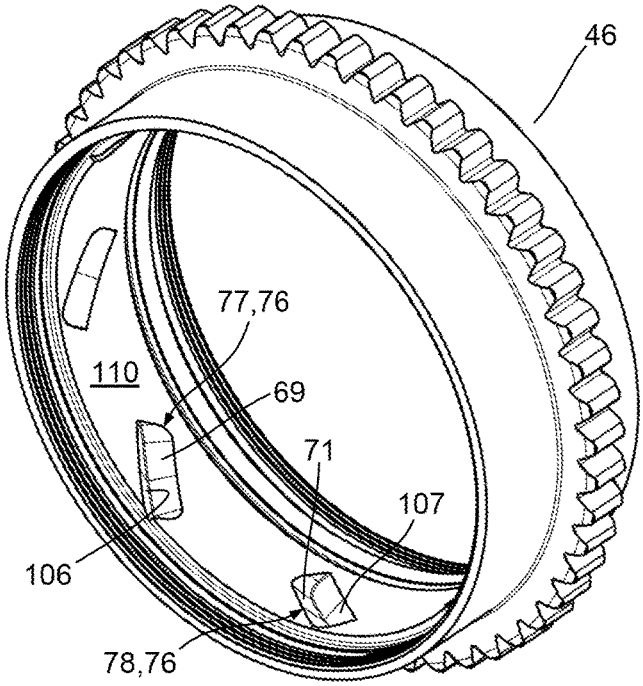
FIG. 21A is a first perspective view of a stator for the phasing mechanism of FIG. 13.
Figure 21B:
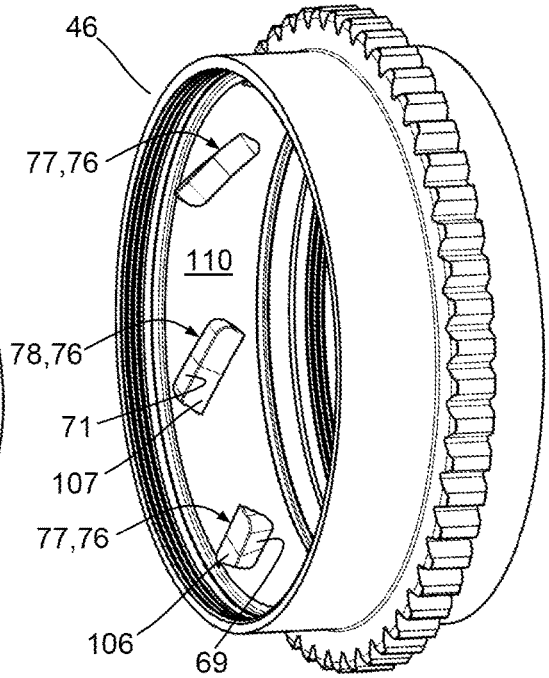
FIG. 21B is a second perspective view of the stator for the phasing mechanism of FIG. 13.
Figure 22:
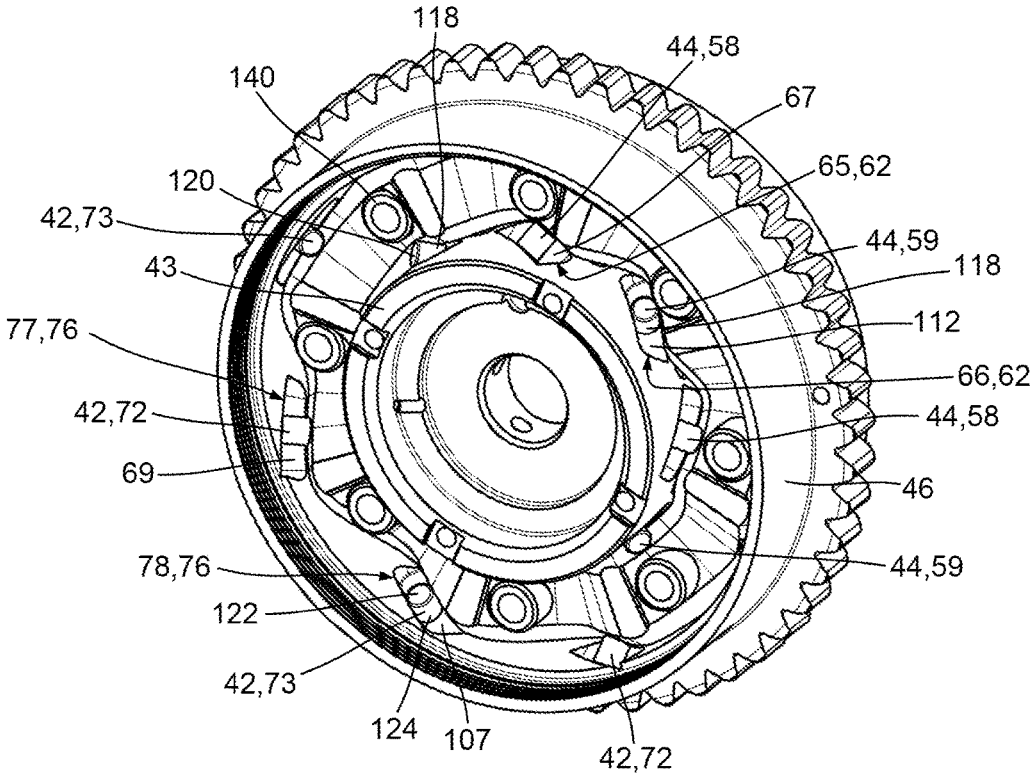
FIG. 22 is a perspective view of a partial assembly of the phasing mechanism of FIG. 13, exposing the inner and outer rolling elements and corresponding ramps.

FIG. 13 is a perspective view of a second embodiment of a phasing mechanism 80 with roller ramps. FIG. 14 is an exploded perspective view of the phasing mechanism 80 of FIG. 13. FIG. 15A is a cross-sectional view of the phasing mechanism 80 of FIG. 13 that shows first hydraulic fluid pathways 95 for adjusting a rotor 43 in a clockwise direction CW relative to a stator 46. FIG. 15B is a cross-sectional view of the phasing mechanism 80 of FIG. 13 that shows second hydraulic fluid pathways 96 for adjusting the rotor 43 in a counterclockwise direction CCW relative to the stator 46. FIG. 16A is a cross-sectional view of the phasing mechanism 80 of FIG. 13 that shows outer rolling elements 42. FIG. 16B is a cross-sectional view of the phasing mechanism 80 of FIG. 13 that shows inner rolling elements 44. FIG. 17 is a cross-sectional view of the phasing mechanism 80 of FIG. 13 that shows a locking pin 61 and a locking pin bias spring 60. FIG. 18 is a perspective view of the rotor 43 of the phasing mechanism 80. FIG. 19 is a perspective view of an inner ramp plate 45 of the phasing mechanism of FIG. 13. FIG. 20 is a perspective view of an outer ramp plate 50 of the phasing mechanism 80 of FIG. 13. FIG. 21A is a first perspective view of the stator 46 of the phasing mechanism 80 of FIG. 13. FIG. 21B is a second perspective view of the stator 46 of the phasing mechanism 80 of FIG. 13. FIG. 22 is a perspective view of a partial assembly of the phasing mechanism 80 of FIG. 13, exposing the inner rolling elements 44, the outer rolling elements 42, and corresponding ramps. The following discussion should be read in light of FIGS. 13 through 22.

The phasing mechanism 80 includes the rotor 43, the stator 46, an inner cover 48, an axial piston bias spring 56, the inner ramp plate 45, the stator 46, the outer ramp plate 50, and an outer cover 47. The inner cover 48 and the outer cover 47 are fixed to the stator 46 via threaded interfaces. The stator 46 is configured to be drivably connected to the first shaft 100 of the IC engine via a gear tooth interface 49, and the rotor 43 is configured to be fixed to the second shaft 102 of the IC engine so that when the rotor 43 rotates, the second shaft 102 rotates together and in unison with the rotor 43. A timing pin 70 is arranged in the rotor 43 to ensure proper timing of the second shaft 102 relative to the rotor 43.

The phasing mechanism 80 utilizes an axial piston 53 that is configured to convert axial force, a resultant of a pressurized hydraulic fluid acting on an area of an axial face of the piston 53, to a rotational torque applied to the rotor 43 to change a relative rotational timing of the second shaft 102 relative to the first shaft 100 of the IC engine. Stated otherwise, axial movement of the axial piston 53 is converted to rotary motion of the rotor 43.

The axial piston 53, as shown in the Figures, is formed by the inner ramp plate 45 and the outer ramp plate 50. Cylindrical spacers 140 are disposed within first counterbore holes 115 of the inner ramp plate 45 and second counterbore holes 116 of the outer ramp plate 50. The cylindrical spacers 140 prevent relative rotation between the inner and outer ramp plates and can provide a means of adjusting an axial offset between the inner and outer ramp plates to adjust a preload of the inner rolling elements 44 and the outer rolling elements 42. Fasteners 57 extend through the first counterbore holes 115, the cylindrical spacers 140, and the second counterbore holes 116 to axially clamp the inner ramp plate 45 to the outer ramp plate 50 to form the axial piston 53. The axial piston 53 could also be formed by just one of either the inner ramp plate 45 or the outer ramp plate 50.

Pressurized hydraulic fluid can be managed by an HFCV arranged remotely from the phasing mechanism 80 or directly integrated within the phasing mechanism 80 like the HFCV 25 shown and described for the previous phasing mechanism 40. Additionally, the previously described pressurization and depressurization strategies for actuating the axial piston 13 in the first and second axial directions AD1, AD2 can also be applied to the axial piston 53 of this phasing mechanism 80. Furthermore, the reaction force vector characteristic of FIG. 12 described for the previous phasing mechanism 40 also applies to this phasing mechanism 80. FIG. 15A shows first fluid galleries 95 that provide a first hydraulic fluid pathway to the first hydraulic actuation chamber 74, and FIG. 15B shows second fluid galleries 96 that provide a second hydraulic fluid pathway to the second hydraulic actuation chamber 75. Together, the first and second fluid galleries 95, 96 can pressurize one side of the axial piston 53 while de-pressurizing the opposite side to axially move the axial piston 53 in the first and second axial directions AD1, AD2. Sealing of the first and second hydraulic actuation chambers 74, 75 is accomplished via an axial piston outer diameter seal 51 and a rotor seal 54. It could be stated that the axial piston 53, particularly the inner rim 152 of the inner ramp plate 5 and the inner rim 84 of the outer ramp plate 10, is slidably guided by an outer diameter of the rotor 43 during axial movement in either the first axial direction AD1 or the second axial direction AD2.

As shown in FIG. 17, the rotor 43 includes a locking pin 61 and a locking pin bias spring 60 that pushes the locking pin 61 radially outward into a channel 105 of the outer ramp plate 50 to achieve a locked condition. Locking of the rotor 43 to the outer ramp plate 50 may be necessary when adequate hydraulic fluid pressure is not available such as during an engine start-up condition.

The optional axial piston bias spring 56 is located within the first hydraulic actuation chamber 74 between the outer cover 47 and the outer ramp plate 50. The axial piston bias spring 56 is formed as a compression spring and is designed to provide an axial biasing force to the axial piston 53 in the first axial direction AD1. When neither of the first actuation chamber 74 or the second actuation chamber 75 are pressurized, such as during an IC engine shutdown condition, the axial piston bias spring 56 can move the axial piston 53 to a first axial stop position. This first axial stop position is achieved when an axial surface 149 of an outer rim 148 of the inner ramp plate 45 abuts with an inner axial surface 2 of the inner cover 48 (see FIG. 17). Similarly, a second axial stop position for the axial piston 53 when moving in the second axial direction AD2 is achieved when an outer axial surface 151 of the outer ramp plate 50 abuts with an inner axial surface 150 of the outer cover 47.

The term "phasing authority" is meant to signify a capable rotational or angular range of a rotor relative to a stator of a phasing mechanism defined by rotational stop positions in each of the phasing directions. The first axial stop position of the axial piston 53 when moving in the first axial direction AD1 corresponds with a maximum clockwise rotational position of the rotor 43 relative to the stator 46; likewise, the second axial stop position of the axial position 53 when moving in the second axial direction AD2 corresponds with a maximum counterclockwise rotational position of the rotor 43 relative to the stator 46. The maximum clockwise rotational position and the maximum counterclockwise rotational position define an angular phasing authority for the phasing mechanism 80. Therefore, the first and second axial stops of the axial piston 53 provide corresponding rotational stops for the rotor 43 which define the phasing authority of the phasing mechanism 80.

For this disclosure, any component that is rigidly attached to the stator 46, such that the stator and the component rotate in unison, is considered to be an element of the stator. Therefore, the inner cover 48 and the outer cover 47 are part of the stator 46 since they are fixed to the stator 46 and rotate in unison as one unit. In this context, it could be stated that the first and second axial stops of the phase adjuster 80 are defined by axial surfaces 149,151 of the axial piston 53 that abut with inner axial surfaces 2, 150 of the stator 46.

The conversion of axial motion of the axial piston 53 to rotary motion of the rotor 43 occurs via: i) inner rolling elements 44 that forcibly engage and roll onto ramps formed within rotor pockets 62 and ramps formed on inner diameters of the inner and outer ramp plates 45, 50; and, ii) outer rolling elements 42 that forcibly engage and roll onto ramps formed within stator pockets 76 on an inner diameter of the stator 46 and ramps formed on an outer diameter of each of the inner and outer ramp plates 45, 50. This rolling element and ramp interaction will now be described.

When the axial piston 53 is actuated in the first axial direction AD1 to move the rotor 43 in a clockwise CW direction relative to the stator 46: i) a first group of inner rolling elements 58 engages a first ramp 67 arranged within each of a first group of rotor pockets 65; and, ii) a first group of outer rolling elements 72 engages a third ramp 69 arranged within each of a first group of stator pockets 77. This rolling incidence of these two groups of rolling elements 58, 72 is initiated by engagement of the first group of inner rolling elements 58 by fifth ramps 79 arranged on an inner diameter of the outer ramp plate 50, and engagement of the first group of outer rolling elements 72 by sixth ramps 52 arranged on an outer diameter of the outer ramp plate 50, respectively, when the first hydraulic actuation chamber 74 is pressurized and the second hydraulic actuation chamber 75 is depressurized.

When the axial piston 53 is actuated in the second axial direction AD2 to move the rotor 43 in a counterclockwise direction CCW relative to the stator 46: i) a second group of inner rolling elements 59 engages a second ramp 68 arranged within each of the second group of rotor pockets 66; and, ii) a second group of outer rolling elements 73 engages a fourth ramp 71 arranged within each of a second group of stator pockets 78. This rolling incidence of these two groups of rolling elements 59, 73 is initiated by engagement of the second group of inner rolling elements 59 by seventh ramps 63 arranged on the inner diameter of the inner ramp plate 45, and engagement of the second group of outer rolling elements 73 by eighth ramps 64 arranged on the outer diameter of the inner ramp plate 45 when the inner ramp plate 45 is actuated by pressurized hydraulic fluid. It should be stated that the rolling elements shown in the figures are shown as rollers, however, any rolling element, including, but not limited to a ball or needle, is possible.

The inner ramp plate 45 and the outer ramp plate 50 are each configured with two groups of ramps, one group is arranged on an inner diameter of each of the ramp plates 45, 50 and one group is arranged on an outer diameter of each of the ramp plates 45, 50. It could be possible to add or eliminate groups of ramps at one or both of the inner and outer diameter locations.

In addition to the previously described first and second ramps 67, 68 that are arranged within each of the respective first and second group of rotor pockets 65, 66, an axial abutment surface for each of the contained first and second groups of inner rolling elements 58, 59 also resides within each of the first and second group of rotor pockets 65, 66. FIG. 18 shows: i) a first axial abutment surface 111 that is formed within each of the first group of rotor pockets 65; and ii) a second axial abutment surface 112 that is formed within each of the second group of rotor pockets 66. The first axial abutment surface 111 retains a first radially inner end 117 of the first group of inner rolling elements 58 (see FIG. 16B); and the second axial abutment surface 112 retains a first radially inner end 118 of the second group of inner rolling elements 59 (see FIG. 22).

A second radially outer end 119 of the first group of inner rolling elements 58 is retained by a third axial abutment surface 113 formed on the inner diameter of the inner ramp plate 45; and, a second radially outer end 120 of the second group of inner rolling elements 59 is retained or limited in axial movement by a fourth axial abutment surface 114 formed on the inner diameter of the outer ramp plate 50.

In addition to the previously described third and fourth ramps 69, 71 that are arranged within each of the respective first and second group of stator pockets 77, 78, an axial abutment surface for each of the contained first and second groups of outer rolling elements 72, 73 also resides within each of the first and second group of stator pockets 77, 78. FIGS. 21A and 21B show: i) a fifth axial abutment surface 106 that is formed within each of the first group of stator pockets 77; and ii) a sixth axial abutment surface 107 that is formed within each of the second group of stator pockets 78. The fifth axial abutment surface 106 retains a second radially outer end 123 of the first group of outer rolling elements 72 (see FIG. 16A); and the sixth axial abutment surface 107 retains a second radially outer end 124 of the second group of outer rolling elements 73 (see FIG. 22).

A first radially inner end 121 of the first group of outer rolling elements 72 is retained by a seventh axial abutment surface 108 formed on an outer diameter of the inner ramp plate 45; and, a first radially inner end 122 of the second group of outer rolling elements 73 is retained or limited in axial movement by an eighth axial abutment surface 109 formed on an outer diameter of the outer ramp plate 50.

The previously described first through fourth axial abutment surfaces 111-114 and the fifth through eighth axial abutment surfaces 106-109 can be helically shaped or formed like that of the corresponding helically formed ramps which define the pathways of the rolling elements. It could be stated that each of the inner rolling elements 44 and outer rolling elements 42 are enclosed or encapsulated by two opposed ramp surfaces and two opposed axial abutment surfaces. Together, the two opposed ramp surfaces and the two opposed axial abutment surfaces form a helically shaped passageway within which the respective rolling elements roll. A cross-section of these respective helical passageways is shown in FIG. 16A (outer rolling element passageway 125) and FIG. 16B (inner rolling element passageway 126).

The rotor pockets 62 and associated ramps and the stator pockets 76 and associated ramps are angled in a helical configuration to produce a rotational response to an axial input provided by the axial piston 53. Other suitable forms of ramps and pockets are also possible.

The axial piston 53 is not fixed relative to the stator 46 but is rollingly connected to the stator 46 via the previously described outer rolling elements 42 and their respective stator pockets 76 formed within an inner radial surface 110 of the stator 46. Due to the helical or angular form of the stator pockets 76 and respective ramp configurations of both the stator pockets 76 and inner and outer ramp plates 45, 50 of the axial piston 53, a rotation of the axial piston 53 relative to the stator 46 occurs during axial movement of the axial piston 53 when hydraulic fluid pressure is applied to either side of the axial piston 53. Simultaneous to this rotation of the axial piston 53, rotational movement of the rotor 43 relative to the stator 46 also occurs due to the previously described rotor pockets 62 and corresponding inner rolling elements 44. As the axial piston 53 is being actuated in either of the first or second axial directions, it rotates in the same direction as the rotor 43. Thus, when the axial piston 53 is actuated in the first axial direction AD1, both the rotor 43 and the axial piston 53 rotate clockwise CW relative to the stator 46 from the perspective shown within the Figures; and when the axial piston 53 is actuated in the second axial direction AD2, both the rotor 43 and the axial piston 53 rotate counterclockwise CCW relative to the stator 46.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A phasing mechanism for an internal combustion engine, the phasing mechanism comprising:

a stator;

a rotor configured to rotate in a first rotational direction and a second rotational direction relative to the stator;

a first plurality of rolling elements configured to engage and move the rotor in the first rotational direction;

a second plurality of rolling elements configured to engage and move the rotor in the second rotational direction;

a piston configured to be hydraulically actuated in:

a first axial direction to move the rotor in the first rotational direction; and a second axial direction to move the rotor in the second rotational direction; and wherein the piston comprises a ramp plate.

2. The phasing mechanism of claim 1, wherein:

actuation of the piston in the first axial direction moves the first plurality of rolling elements so that the rotor moves in the first rotational direction; and actuation of the piston in the second axial direction moves the second plurality of rolling elements so that the rotor moves in the second rotational direction.

3. The phasing mechanism of claim 1, wherein:

the first plurality of rolling elements is configured to engage and roll on a first plurality of ramps arranged on the rotor to move the rotor in the first rotational direction; and the second plurality of rolling elements is configured to engage and roll on a second plurality of ramps arranged on the rotor to move the rotor in the second rotational direction.

4. The phasing mechanism of claim 3, wherein the piston includes:

a third plurality of ramps; and a fourth plurality of ramps; and when the piston is hydraulically actuated in the first axial direction, the third plurality of ramps engages the first plurality of rolling elements so that the first plurality of rolling elements move the rotor in the first rotational direction; and when the piston is hydraulically actuated in the second axial direction, the fourth plurality of ramps engages the second plurality of rolling elements so that the first plurality of rolling elements move the rotor in the second rotational direction.

5. The phasing mechanism of claim 4, further comprising:

a third plurality of rolling elements arranged radially between the piston and the stator, the third plurality of rolling elements configured to roll on a fifth plurality of ramps arranged on the stator when the piston is hydraulically actuated in the first axial direction; and a fourth plurality of rolling elements arranged radially between the piston and the stator, the fourth plurality of rolling elements configured to roll on a sixth plurality of ramps arranged on the stator when the piston is hydraulically actuated in the second axial direction.

6. The phasing mechanism of claim 5, wherein the first plurality of ramps, the second plurality of ramps, the third plurality of ramps, the fourth plurality of ramps, the fifth plurality of ramps and the sixth plurality of ramps are helical surfaces.

7. The phasing mechanism of claim 1, wherein the first plurality of rolling elements includes:

a first plurality of inner rolling elements arranged radially between the piston and the rotor; and a first plurality of outer rolling elements arranged radially between the piston and the stator.

8. The phasing mechanism of claim 7, wherein the second plurality of rolling elements includes:

a second plurality of inner rolling elements arranged radially between the piston and the rotor; and a second plurality of outer rolling elements arranged radially between the piston and the stator.

9. The phasing mechanism of claim 1, further comprising a bias spring, a first end of the bias spring attached to the stator, and a second end of the bias spring attached to the piston.

10. The phasing mechanism of claim 9, wherein the bias spring prevents relative rotation between the piston and the stator.

11. The phasing mechanism of claim 1, wherein the piston abuts with the stator to define a rotational stop for the rotor.

12. The phasing mechanism of claim 11, wherein the piston is formed by an inner ramp plate and an outer ramp plate.

13. A phasing mechanism for an internal combustion engine, the phasing mechanism comprising:

a stator;

a rotor configured to rotate in a first rotational direction and a second rotational direction relative to the stator;

a piston having:

a first side forming a first hydraulic actuation chamber with the stator, the first hydraulic actuation chamber configured to receive pressurized hydraulic fluid to move the piston in a first axial direction; and a second side forming a second hydraulic actuation chamber with the stator, the second hydraulic actuation chamber configured to receive pressurized hydraulic fluid to move the piston in a second axial direction;

axial movement of the piston in the first axial direction and the second axial direction is translated to rotational movement of the rotor respectively in the first rotational direction and the second rotational direction via a plurality of rolling elements arranged radially between the piston and the rotor; and wherein the piston comprises a ramp plate.

14. The phasing mechanism of claim 13, further comprising a plurality of ramps arranged on a radial outer surface of the rotor, and each one of the plurality of rolling elements is configured to roll on a corresponding one of the plurality of ramps so that the rotor moves: i) in the first rotational direction when the piston is actuated in the first axial direction, and ii) in the second rotational direction when the piston is actuated in the second axial direction.

15. The phasing mechanism of claim 14, wherein:

the plurality of ramps comprises a first plurality of ramps and a second plurality of ramps;

the plurality of rolling elements comprises:

a first plurality of rolling elements, each one of the first plurality of rolling elements is configured to roll on a corresponding one of the first plurality of ramps when the piston is actuated in the first axial direction; and a second plurality of rolling elements, each one of the second plurality of rolling elements is configured to roll on a corresponding one of the second plurality of ramps when the piston is actuated in the second axial direction.

16. The phasing mechanism of claim 13, further comprising a hydraulic fluid control valve configured to fix the rotor to a shaft of the internal combustion engine, the hydraulic fluid control valve having a spool configured to move to one of a plurality of axial positions to hydraulically actuate the piston in the first and second axial directions.

17. The phasing mechanism of claim 13, further comprising a bias spring arranged to apply an axial biasing force on the piston.

18. A phasing mechanism for an internal combustion engine, the phasing mechanism comprising:

a stator;

a rotor configured to rotate in a first rotational direction and a second rotational direction relative to the stator;

a piston having a radial inner surface slidably guided by the rotor, the piston configured to be hydraulically actuated in: i) a first axial direction via a first axial side of the piston, and ii) a second axial direction via a second axial side of the piston; and when the piston is hydraulically actuated in the first axial direction:

a first ramp of the piston engages a first rolling element such that the first rolling element forcibly rolls on a second ramp arranged on the rotor such that the first rolling element imparts a first force on the rotor in the first rotational direction; and when the piston is hydraulically actuated in the second axial direction:

a third ramp of the piston engages a second rolling element such that the second rolling element forcibly rolls on a fourth ramp arranged on the rotor such that the second rolling element imparts a second force on the rotor in the second rotational direction; and wherein the piston comprises a ramp plate.

19. The phasing mechanism of claim 18, wherein the rotor further comprises a locking pin configured to lock the rotor to the piston.

20. The phasing mechanism of claim 18, further comprising a bias spring arranged to apply an axial biasing force to the piston.

* * * * *